US006807794B2

(12) United States Patent
Ausnit et al.

(10) Patent No.: US 6,807,794 B2
(45) Date of Patent: Oct. 26, 2004

(54) METHODS OF MAKING A GUSSET STYLE POUCH IN A RECLOSABLE BAG

(75) Inventors: Steven Ausnit, New York, NY (US); Donald L. Crevier, Essex, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/364,750

(22) Filed: Feb. 11, 2003

(65) Prior Publication Data

US 2004/0154268 A1 Aug. 12, 2004

(51) Int. Cl.[7] ..... B65B 61/18

(52) U.S. Cl. ..... 53/412; 53/133.4; 53/139.2; 493/114; 493/213; 493/927

(58) Field of Search ..... 53/412, 133.4, 53/213, 139.2; 156/270, 269, 324; 493/215, 114, 213, 394, 927

(56) References Cited

U.S. PATENT DOCUMENTS 4,175,604 A * 11/1979 Bonner ..... 383/5
4,840,611 A * 6/1989 Van Erden et al. ..... 493/213
5,186,707 A * 2/1993 Barta ..... 493/439
5,692,837 A * 12/1997 Beer ..... 383/210.1
5,816,018 A * 10/1998 Bois ..... 53/133.4
6,017,412 A * 1/2000 Van Erden et al. ..... 156/290
6,082,897 A * 7/2000 Galomb ..... 383/63
6,254,519 B1 * 7/2001 Toshima ..... 493/214
6,397,561 B1 * 6/2002 Matthews ..... 53/412
6,519,917 B2 * 2/2003 Forman ..... 53/412

* cited by examiner

*Primary Examiner*—Stephen F. Gerrity
*Assistant Examiner*—Sameh H. Tawfik
(74) *Attorney, Agent, or Firm*—Pitney Hardin LLP

(57) ABSTRACT

A method for making a reclosable bag (56) with gussets (36, 38) in which a zipper profile (16) is attached to bag-making film (10), while leaving side margins (20, 22) of the film. The film (10) is folded as a tube (26). Gusset-forming wheels (34, 35) indent the tube (26) to form the side gussets (36, 38). The side gussets (36, 38) are sealed to the tube (26) and/or the zipper profile (18) with the profile sealed to the tube. The tube (26) is sealed and cross-cut to form the bag (56). In an alternative method, lengths of tubular gusset material (112) are positioned on a lower web (110) of film (101) transverse to a bag-forming direction. A zipper (124) is sealed in the bag-forming direction to the webs (108, 110), and the gusset material (112). The webs (108, 110) and the material (112) are sealed to each other to form an end seal (140) as well as cross-cut and sealed to form the gussets (144, 148) of a reclosable bag (147). The webs (108, 110) may be sealed above the zipper (124) to form a tamper-evident feature (166).

4 Claims, 28 Drawing Sheets

METHODS OF MAKING A GUSSET STYLE POUCH IN A RECLOSABLE BAG

FIELD OF THE INVENTION

The present invention relates to reclosable plastic bags of the type in which perishable food products and other goods are packaged for sale to consumers in retail outlets. More specifically, the present invention relates to a method for concurrently manufacturing plastic bags with gussets in the pouch of the bag.

DESCRIPTION OF THE PRIOR ART

The present invention relates to improvements in the package-making art and may be practiced in the manufacture of reclosable plastic bags and packages of the type that may be used for various consumer products. Such packages often include a form of peel-seal to render the package moisture-tight and/or airtight prior to the initial opening, and/or for use as a tamper-evident seal. A zipper means protects any remainder of the product therein after the initial opening.

The indicated art is fairly well-developed but nevertheless remains open to improvements contributing to increased efficiency and cost-effectiveness. In the prior art, McMahon et al. (U.S. Pat. No. 4,909,017) discloses a method for making a package with a reclosable fastener on a form-fill-and-seal machine. Prior to entering the form-fill-and-seal machine, zippers are attached to the surface of the film used to make the package, with the zippers transversely attached to the running direction of the film at bag-length intervals. Only one of the interlocking profiles of the zipper is attached by its flange section to a surface of the film with the other interlocked profile facing upwardly or, in other words, inwardly toward the interior of the bag to be formed. The film is advanced to the form-fill-and-seal machine and drawn down over a forming collar and about the filling tube, with the longitudinal side edge margins of the film brought together and seamed with a fin seal to form a tube. Cross-seals are made on the tube to join the unattached profile of the zipper to the film and to form the ends of the bag and following bags.

The commonly assigned patent application "Process and Apparatus for Forming Packaging Bags With a Fastener" (U.S. Ser. No. 09/633,944, allowed Jul. 26, 2002) discloses a method in which a slider for opening and closing the fastener is attached to the fastener before the fastener is attached to the film being advanced to the form-fill-and-seal machine. Various components of the form-fill-and-seal machine allow the fastener with attached slider to advance in the machine and to be part of the formed reclosable bag.

The commonly assigned patent application "Method of Forming Gusseted Reclosable Bags" (U.S. Ser. No. 09/726,731, allowed Oct. 2, 2002) discloses a method for forming the reclosable packaging with gussets. In the method, first and second carrier webs are provided which include discrete mating zipper profile sections. The zipper profile sections are separated from each other on the carrier web by zipper-free sections of the carrier web. The carrier webs are attached to the first ends of first and second bag wall films as the bag wall films, respectively, are brought together. The bag wall films may be separate webs or a single longitudinally folded web. The carrier webs are formed of thinner-gauge plastic film than the bag wall films. The first and second bag wall films and the first and second carrier webs are cross-sealed with the carrier webs being sealed through the zipper-free sections of the web, and the assembly is transversely cut through the cross-seals to form a bag. A second end gusset is formed in the bag by reverse-folding the second end of the bag walls. If the bag walls are formed from separate films, the films must be connected either by simply sealing the second ends of the bag wall film to each other or by sealing a folded second end web to the second ends of both bag wall films. Side gussets are then formed by pushing in the end parts of the bag walls as well as the zipper-free sections of the carrier web between the open zipper sections.

An improvement in the above methods and the apparatus used in the above methods is the ability to provide side gussets in the pouch portion of the reclosable bags to be formed, in which the side gussets are formed in the pouch portion or in which a length of gusset material is sealed in the pouch portion in a manner that would not restrict the opening of the reclosable bag nor affect the use of the interlocking elements of the zipper of the bag.

SUMMARY OF THE INVENTION

Accordingly, the present invention relates to a method for producing reclosable plastic bags with expandable gussets in which the bags are manufactured in an efficient manner that readily lends itself to automated production.

In a first embodiment of the present invention, a first interlocking profile of a length of zipper is attached by one of its flanges to a mid-portion of a continuous length of bag-making film at a direction transverse to the running direction of the film, while leaving side margins of film on opposite ends of the zipper so that the combined length of the side margins of film is greater than the length of the zipper.

As the bag-making film is advanced, the side margin on one end of the zipper is sealed to the side margin on an opposite end of the zipper to form a fin seal. The fin seal forms the longitudinal seam of a tube with an inside surface of the rear wall of the tube facing the unattached profile of the zipper. As the tube is advanced, retractable gusset-forming wheels wedge and indent the side margins to form side gussets such that the base of the formed side gussets defines the longitudinal borders of the rear wall.

For a zipper with an inserted slider, the retractable gusset-forming wheels form the side gussets adjacent the interlocking elements of the zipper to allow the slider to fully open and close the interlocking elements. The amount and size of the gusset-forming wheels extending into each side margin may vary to produce multiple side gussets of different sizes in each side margin of the film. The unattached interlocking profile of the zipper is sealed by its flange section to an inner surface of the rear wall that is formed by the remaining portions of the side margins. A section of the gussets is sealed to the rear wall adjacent the interlocking elements of the zipper to form a border area below the zipper. The border area allows access to the interior of the bag only through the zipper area of the bag.

For a zipper without a slider, the tube proceeds in a bag-forming direction to a sealing section. The sealing section seals the unattached zipper profile by its flange to a face of each side gusset and to an inner surface of the rear wall of the tube in which the longitudinal borders of the rear wall are defined by the base of the side gussets. An opposite face of each side gusset is sealed to the inner surface of the rear wall as a border area to ensure that access to the contents of the formed reclosable bag is through the zipper only. The opposite face of each side gusset is sealed to the rear wall parallel to and below the sealing of the zipper to form the border area at and below the zipper.

The sealing section forms end stops on the zipper to prevent the zipper from separating and to prevent tearing into the bag at the ends of the zipper. The end stops also retain the slider on the zipper when the slider is used to open and close the bag. After the sealing operation, the sealing section separates the tube with an internal cutting device to form a reclosable bag and seals the film to form an end seal of a preceding reclosable bag. Another end seal may be formed as a part of a tamper-evident section of film adjacent the zipper of the reclosable bag.

In a second embodiment of the present invention, a first continuous length of bag-making film and a second continuous length of bag-making film are fed toward each other in a bag-forming direction from their respective supply rolls. The first length of film is fed to become the upper web and the second length of film is fed to become the lower web of the formed reclosable bag. First and second lengths of gusset material, each in the shape of an elongated tube, are positioned on the lower web transverse to the bag-forming direction. A first end of each length of gusset material is tack-sealed to the lower web.

A zipper is positioned on the lower web and on the first end of the lengths of gusset material and, if the zipper includes a slider, with the interlocking elements of the zipper adjacent the ends of the gusset material. A set of rollers advances the webs while flattening the gusset material. The flanges of the zipper are sealed to the upper and lower webs and over the first end of the lengths of gusset material.

In a first variation of the second embodiment of the present invention, the upper and lower webs are fed toward each other to provide film extensions on an opposite side of the zipper from the ends of the gusset material.

In a second variation of the second embodiment of the present invention, the tubular lengths of gusset material are fed between the flanges of the zipper. For the second embodiment and its first and second variations, the upper and lower webs, as well as the second end of the tubular lengths of gusset material, are sealed to form an end seal or a bottom seal of the reclosable bag.

The assembly of the webs and the zipper is advanced and transversely cut to the bag-forming direction and sealed to form a transverse seal at a leading edge. Also at the leading edge, the tubular length of gusset material is cut along a centerline of the length to form a side gusset while sealing the cut section of the gusset material to the webs as part of the transverse seal. The assembly of the webs, the zipper and the gusset material are advanced to a reclosable bag width in which a trailing edge is cut in the webs, in the zipper and in the gusset material to form the reclosable bag with a second side gusset at the trailing edge. Also at the trailing edge, the cut section of the gusset material is sealed to the webs as part of a transverse seal.

After the bag is filled with a consumer product, the open ends of the film extensions may be sealed to provide a tamper-evident feature which encloses the zipper. A weakness area is formed in the film extensions to tear away the film in order to access the zipper during an opening of the reclosable bag.

In a third variation of the second embodiment of the present invention, a semi-elliptical length of gusset material is inserted between the upper and lower webs and in a slit area of the first and second lengths of gusset material to form a bottom gusset of the reclosable bag.

BRIEF DESCRIPTION OF THE DRAWINGS

Further objects and advantages of the invention will become apparent from the following description and claims taken in conjunction with the accompanying drawings, in which:

DETAILED DESCRIPTION OF THE PREFERRED EMBODIMENTS

Figure 1:
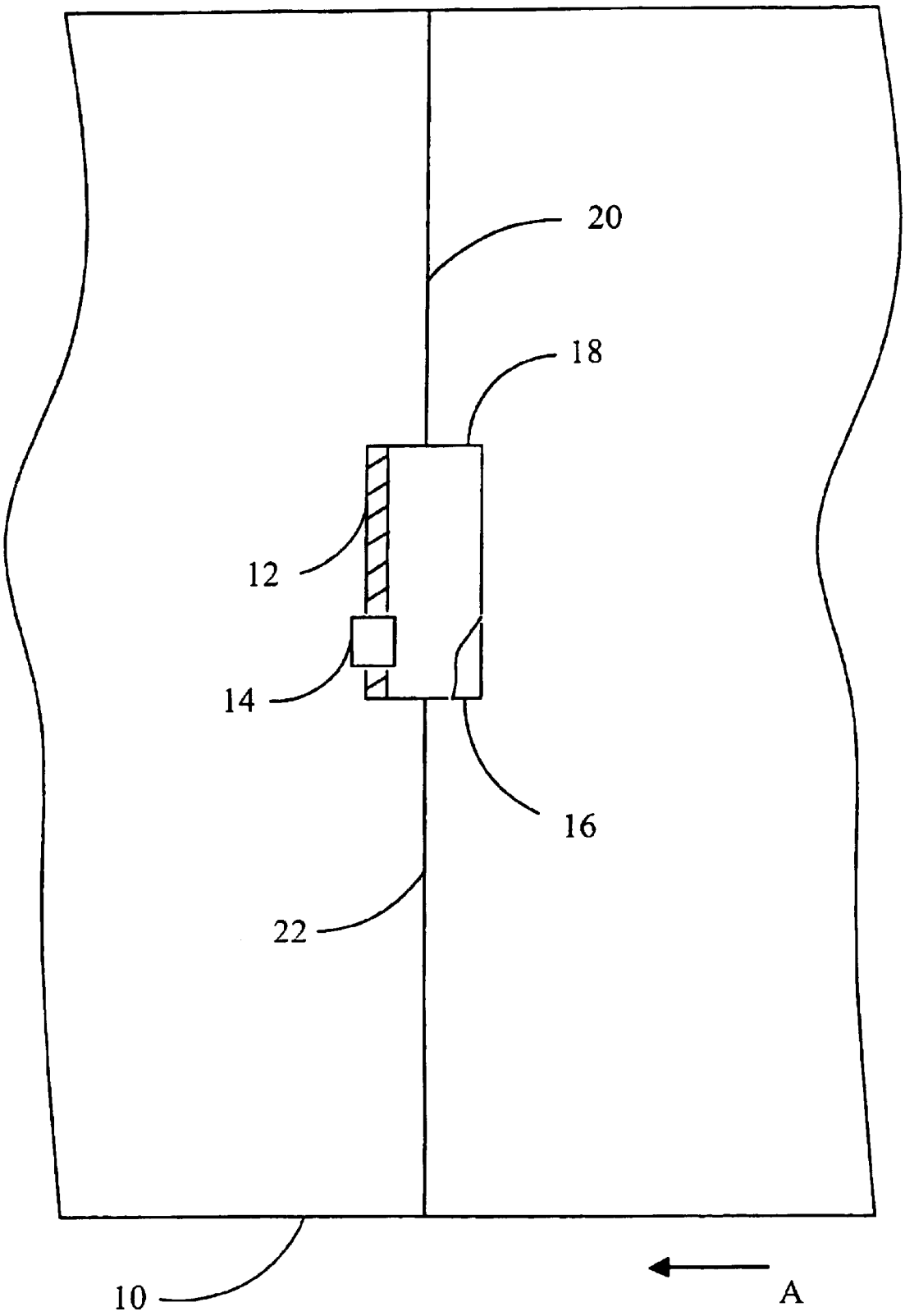
FIG. 1 is a plan view of a length of zipper attached to a mid-portion of the bag-making film of the present invention wherein the positioning of the zipper to the width of the bag-making film is a component of the first embodiment of the present invention.

Referring now to the drawings in detail in which like numerals indicate like elements throughout the several views, a continuous length of thermoplastic film 10 is shown in FIG. 1 in which the thermoplastic film is advanced in running direction "A". In FIG. 1, a length of zipper 12 with an inserted slider 14 for opening and closing the zipper is attached to a mid-portion of the film 10 and transverse to the direction "A". With the profiles of the zipper 12 joined by their interlocking elements, only the flange of profile 16 that rests on the film 10 is attached to the film while the other profile 18 is secured by the engagement of the interlocking elements. After attachment of the zipper 12, side margins 20, 22 are formed which extend from the transverse ends of the zipper to the longitudinal edges of the film 10. In this regard, the combined length of the side margins 20, 22 is greater than the length of the zipper 12. The greater length of the side margins 20, 22 allows proper sealing of the reclosable bag and the formation of side gussets, as will be discussed later.

Figure 2:
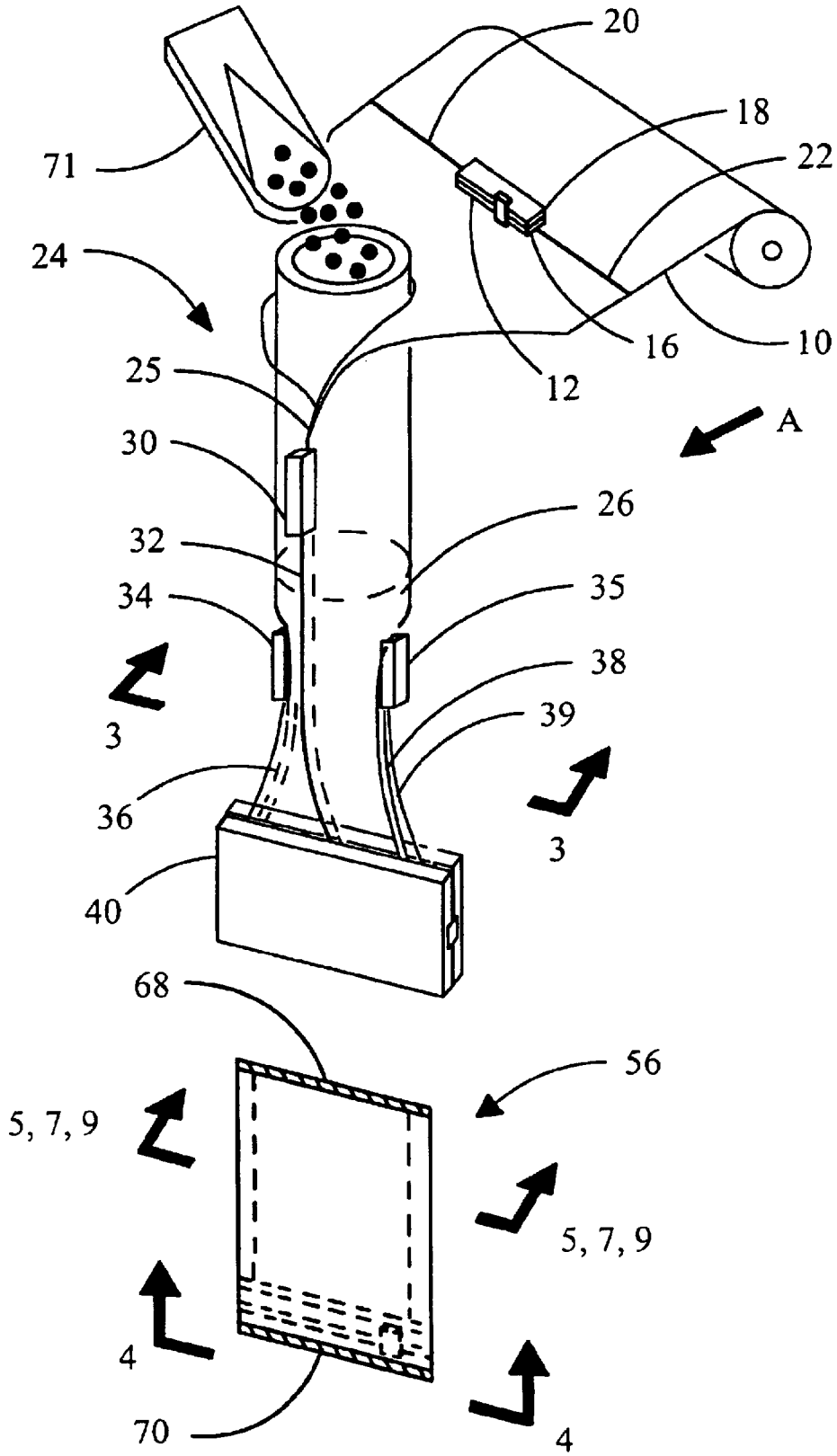
FIG. 2 is a perspective view of an alternative form-fill-and-seal machine used in the first embodiment of the present invention wherein side gussets are indented into a tube formed by bag-making film.
Figure 3:
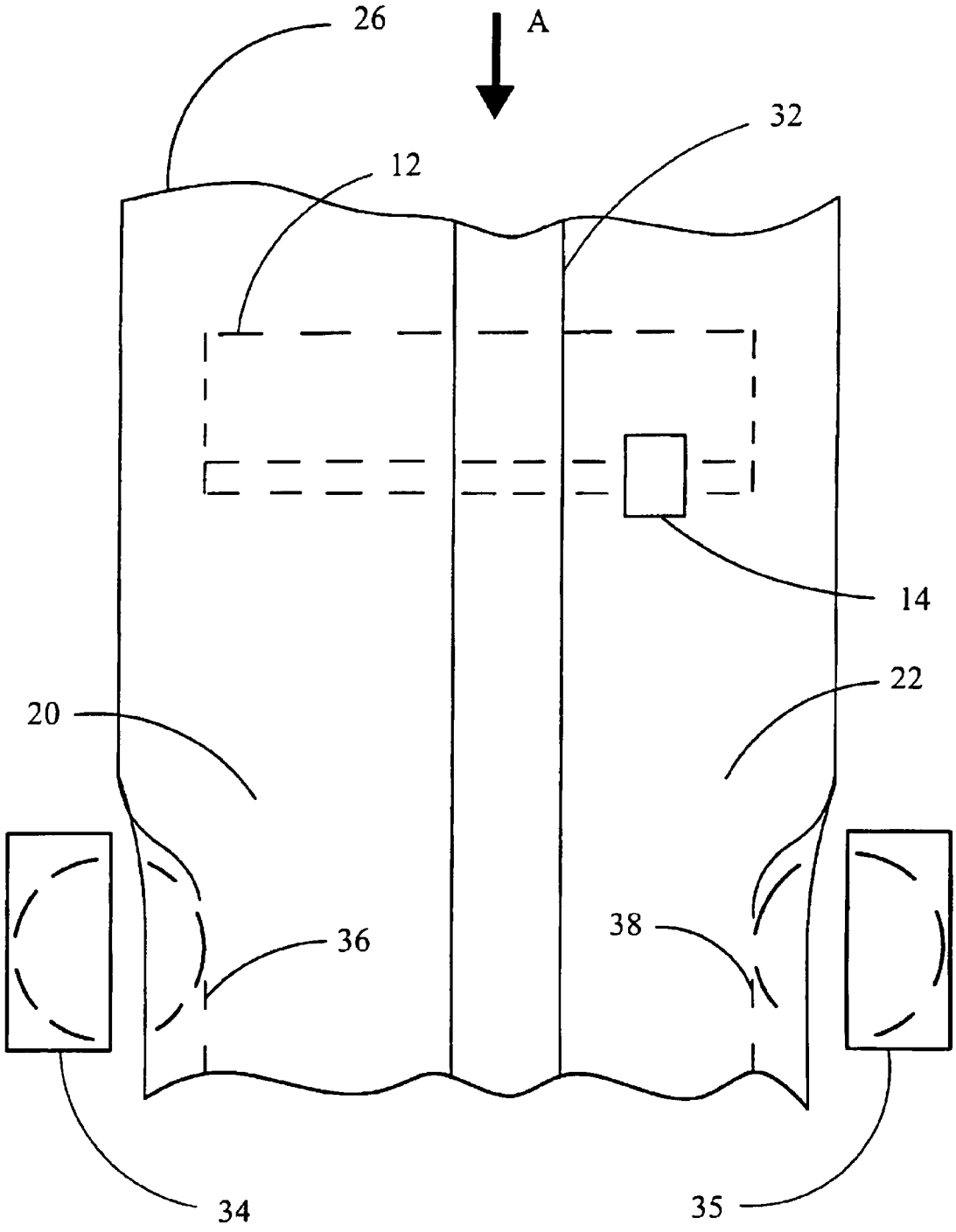
FIG. 3 is a front view of the retractable gusset-forming wheels of the alternative form-fill-and-seal machine of the first embodiment of the present invention, with the view taken from reference line 3—3 of FIG. 2.

As shown in FIG. 2, the film 10 is advanced and folded by a form-fill-and-seal machine 24 to bring the side margins 20, 22 together at a fin 25 to thereby form the film into a tube 26. The side margins 20, 22 are seamed together by a longitudinal sealing bar 30, thereby forming a fin seal 32 on a rear wall that faces the unattached profile 18 of the zipper 12. As shown in the figure and in further detail in FIG. 3, retractable gusset-forming wheels 34, 35 wedge and indent the side margins 20, 22 as the film 10 is advanced in direction "A" to form side gussets 36, 38.

For a zipper 12 with the inserted slider 14, the retractable gusset-forming wheels 34, 35 form the side gussets 36, 38 adjacent the interlocking elements of the zipper to allow the slider to operate on the full length of the zipper. The size of gusset-forming wheels 34, 35 extending into each side margin may vary to produce different size gussets in each side margin. The flange of the unattached profile 18 is sealed to an inner surface of a rear wall 39 that is formed by the remaining portions of the side margins 20, 22.

Figure 4:
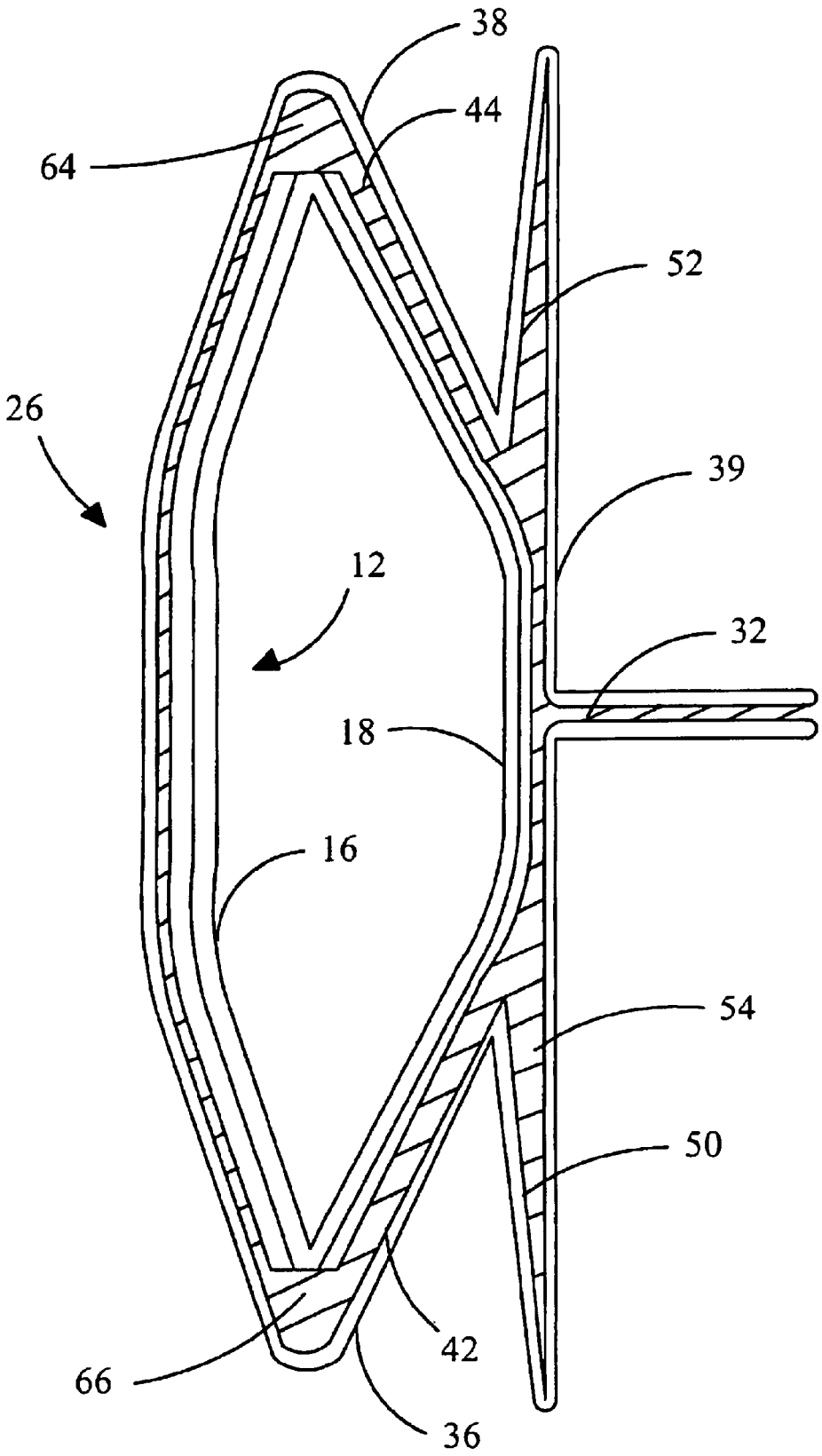
FIG. 4 is an end view of the side gussets and the zipper sealed to the bag-making film of the present invention with the zipper opened to clarify the locations of sealing and with the view taken from reference line 4—4 of FIG. 2.

For a zipper 12 without an inserted slider 14, the tube 26 proceeds in direction "A" to a sealing section 40 which seals the side gussets 36, 38 and the flange of unattached profile 18 of the zipper to the tube and to each other. As shown in the end view of an opened zipper 12 in FIG. 4, the profile 18 is sealed to a face 42 of the side gusset 36 and to a face 44 of the side gusset 38, as well as to an inner surface of the rear wall 39. An opposite face 50 of the side gusset 36 and an opposite face 52 of the side gusset 38 are sealed to the inner surface of the rear wall 39 to form a border area 54 that ensures access to the contents of the formed reclosable bag 56 is through the zipper 12 only.

Figure 5:
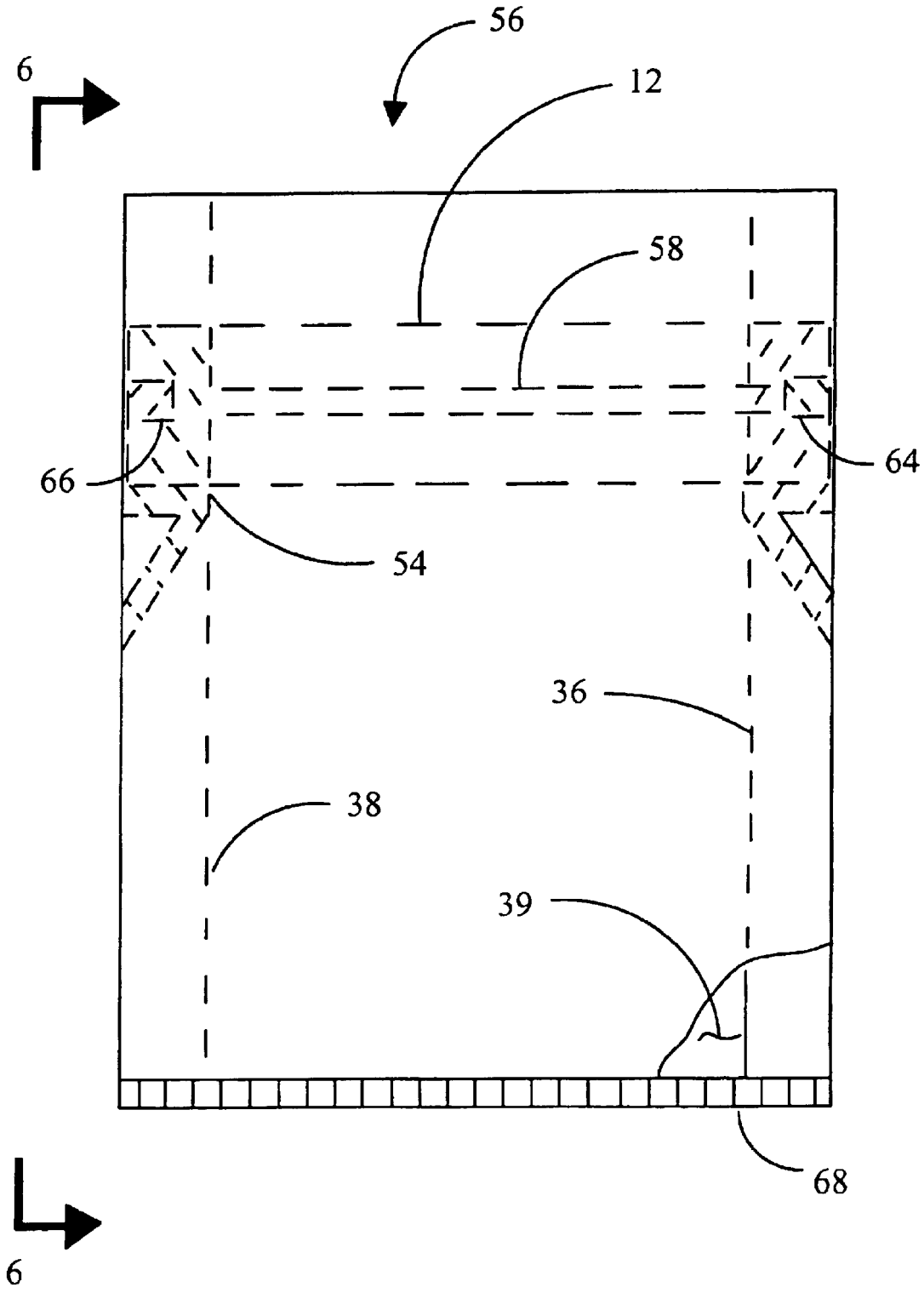
FIG. 5 is a front view of a reclosable bag formed by the first embodiment of the present invention wherein the side gussets are sealed to a flange of the zipper and the rear wall of the reclosable bag to form a border area at and below the interlocking elements of the zipper, with the view taken from reference line 5—5 of FIG. 2.
Figure 6:
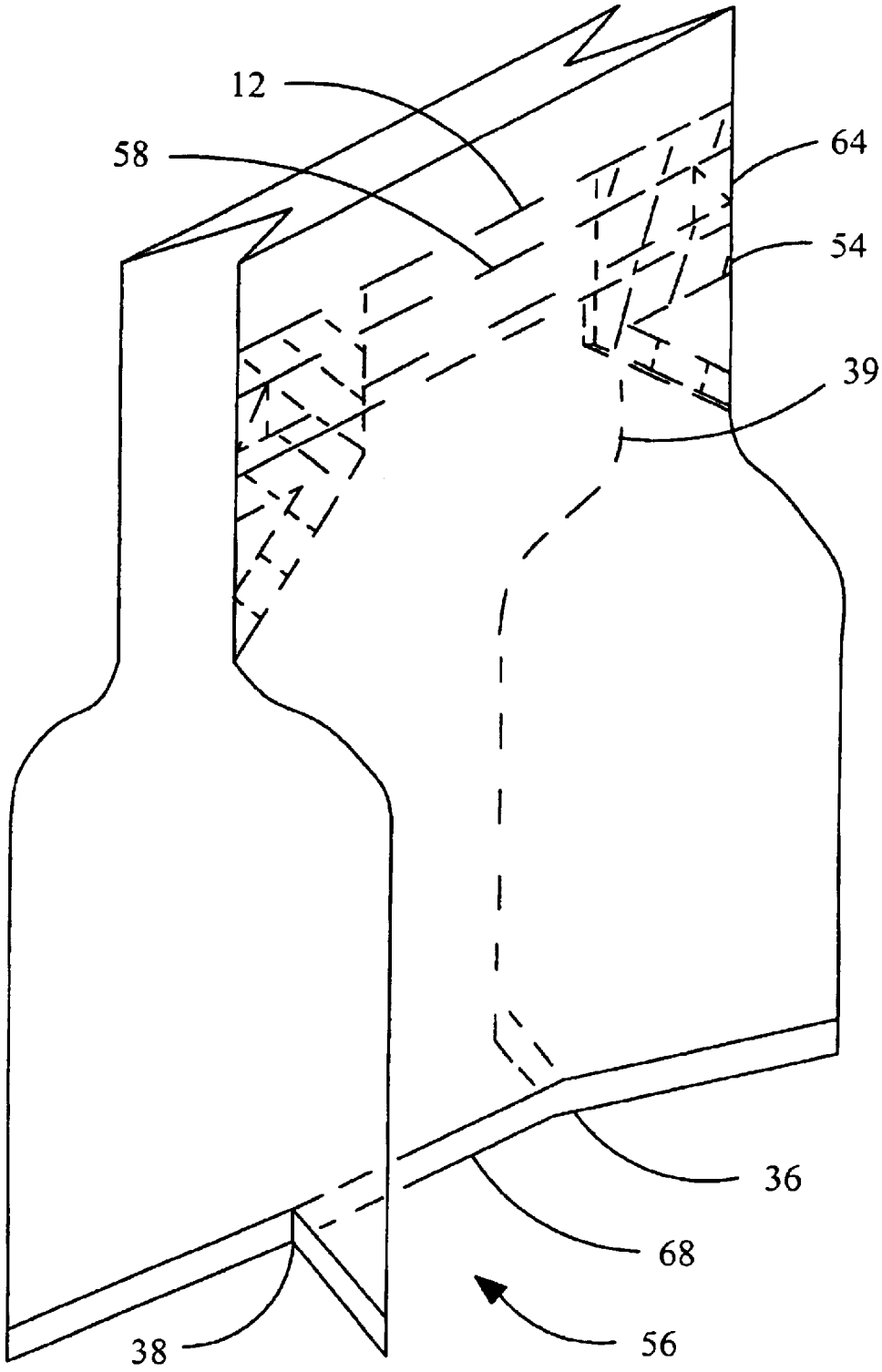
FIG. 6 is a perspective view of a reclosable bag formed by the first embodiment of the present invention, with the view taken from reference line 6—6 of FIG. 5.
Figure 7:
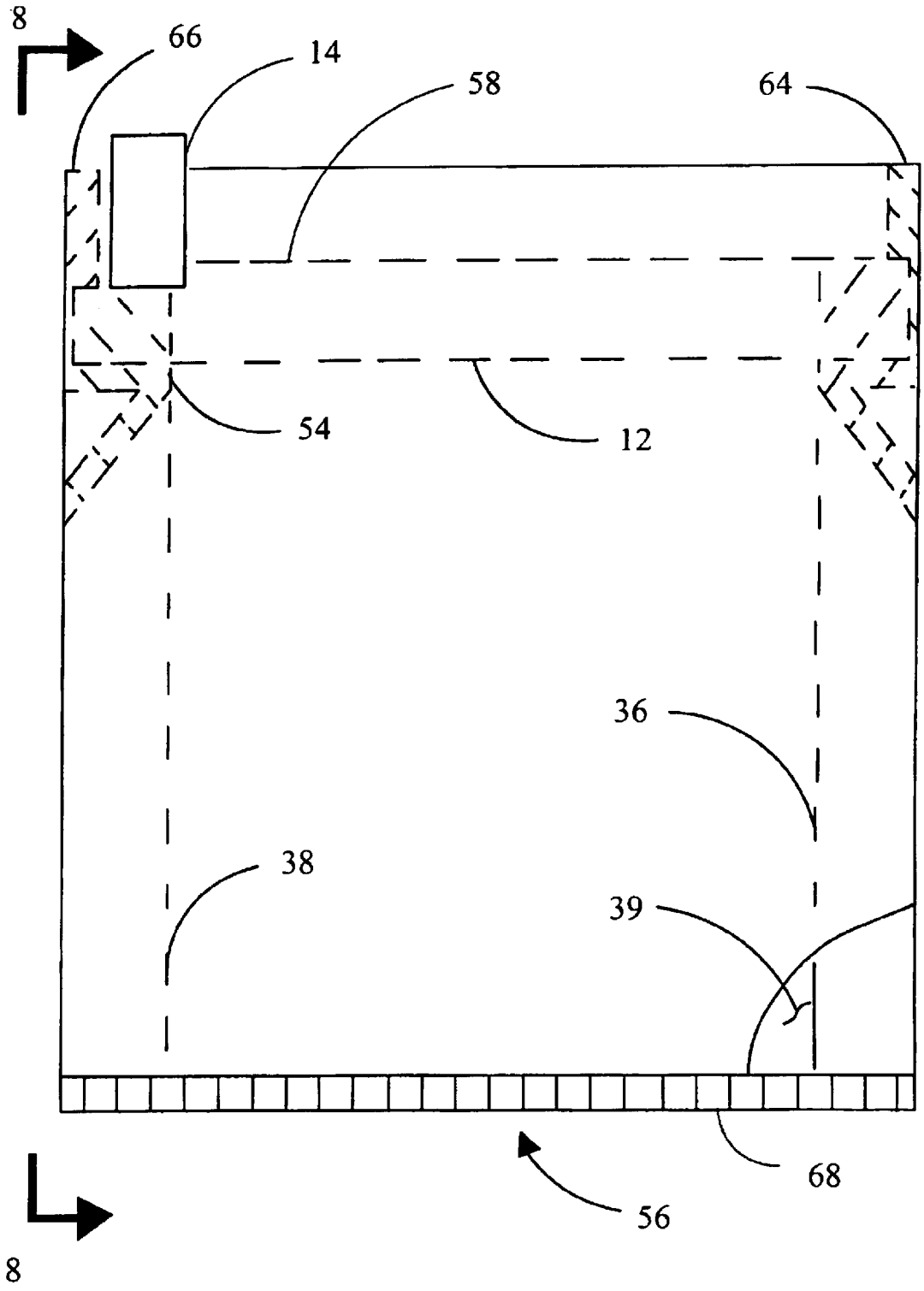
FIG. 7 is a front view of a reclosable bag formed by the first embodiment of the present invention wherein the sealed area of the side gussets forms a border area adjacent the interlocking elements of the zipper, with the view taken from reference line 7—7 of FIG. 2.
Figure 8:
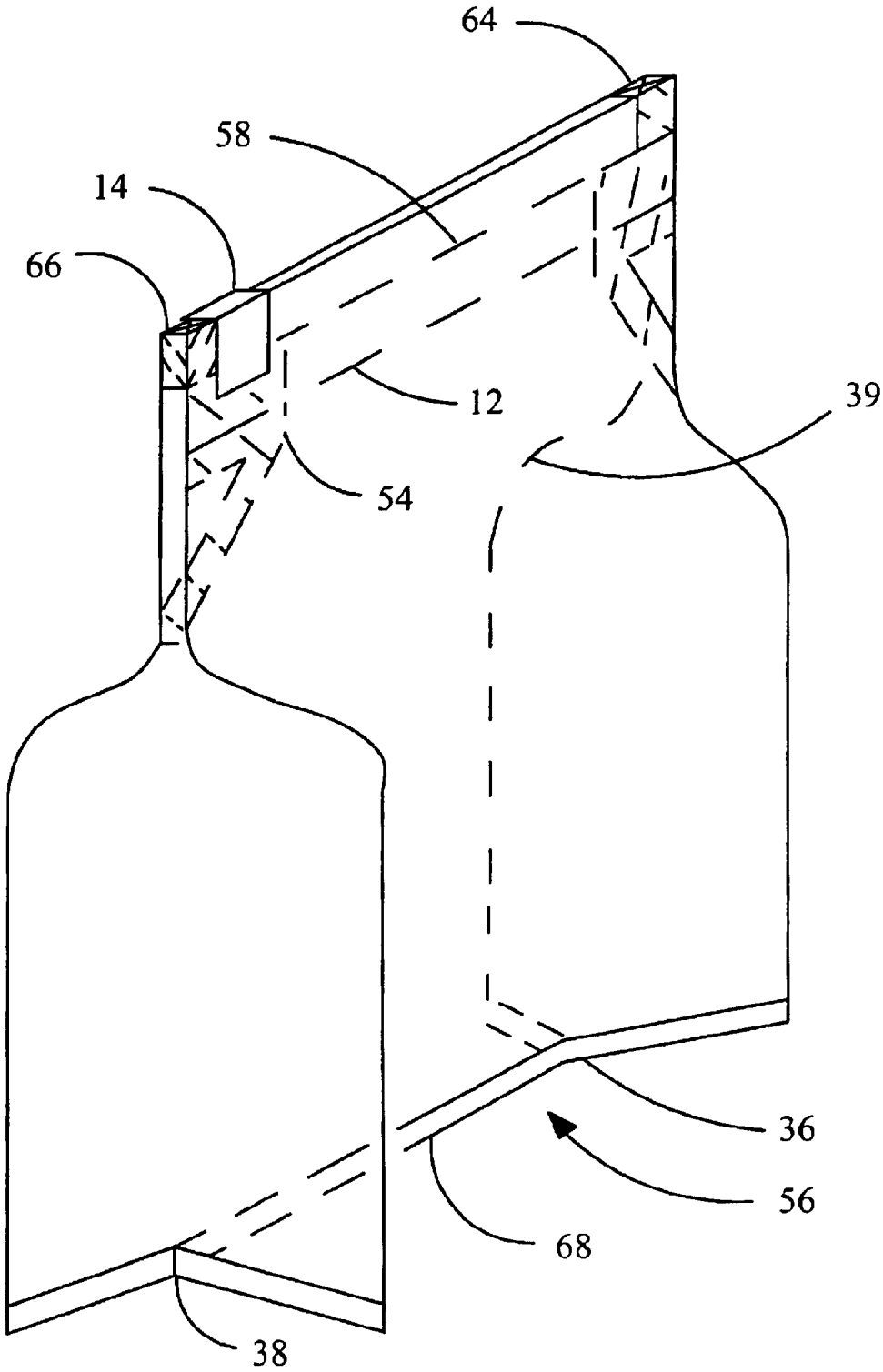
FIG. 8 is a perspective view of a reclosable bag formed by the first embodiment of the present invention, with the view taken from reference line 8—8 of FIG. 7.

As shown in FIGS. 5 and 6, the side gussets 36, 38 are sealed to the rear wall 39 parallel to the sealing of zipper 12 to the film 10 to form the border area 54 at and below the interlocking elements of the closure area 58 of the zipper. As shown in FIGS. 7 and 8, for a zipper 12 with an inserted slider 14 the side gussets 36, 38 are sealed adjacent the interlocling elements of the closure area 58 with the side gussets sealed to the rear wall 39 to form the border area 54 of the reclosable bag 56. By sealing adjacent the closure area 58, the slider 14 can open and close the interlocking elements of the zipper without interference by the border area 54.

The sealing section 40 of FIG. 2 also forms end stops 64, 66 on the zipper 12 to prevent the zipper from separating or tearing into the bag at the ends. The end stops 64, 66 also retain the slider 14 on the zipper during opening and closing. After sealing, the sealing section 40 separates the tube 26 with an internal cutting device to form the reclosable bag 56 while sealing the film 10 of the tube to form an end seal 68 of a preceding reclosable bag and/or an end seal 70 adjacent the zipper 12.

Figure 9:
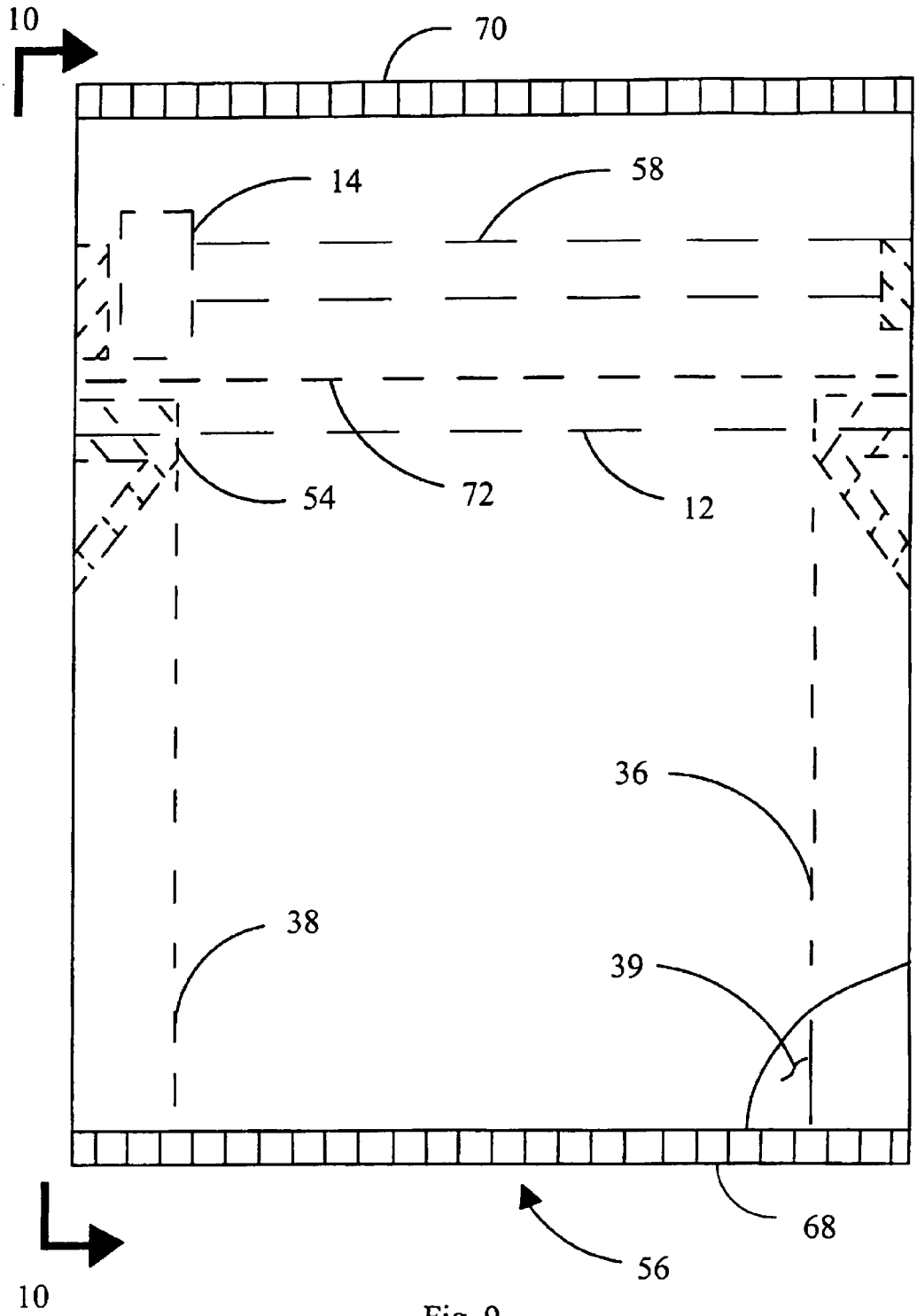
FIG. 9 is a front view of a reclosable bag formed by the first embodiment of the present invention wherein a reclosable bag with side gussets is also formed with an end seal as a tamper-evident feature, with the view taken from reference line 9—9 of FIG. 2.
Figure 10:
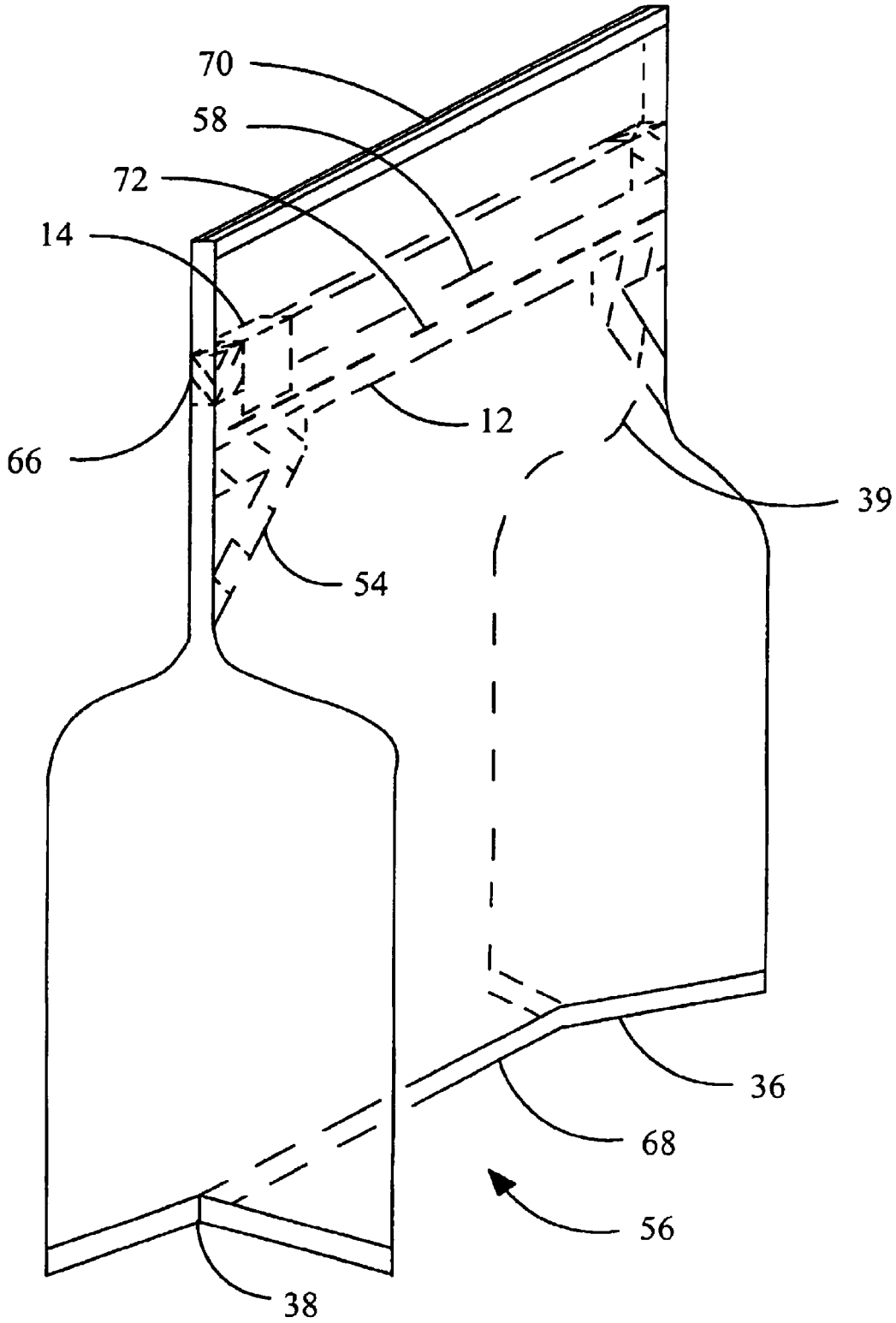
FIG. 10 is a perspective view of a reclosable bag formed by the first embodiment of the present invention with the view taken from reference line 10—10 of FIG. 9.

If the sealing section 40 forms the end seal 70 shown on the reclosable bag of FIGS. 9 and 10, the bag should be previously filled by a product supply 71, shown in FIG. 2. A second internal cutting device of the sealing section 40 perforates the film as a weakness area 72. Alternatively, the weakness area 72 may be formed as a notched section of the tube 26 or as any other weakness area known to those skilled in the art. The weakness area 72 allows the film 10 to be torn away adjacent the zipper 12 in order to access the contents of the reclosable bag. As such, the end seal 70 and the adjacent film section can also serve as a tamper-evident feature.

Figure 11:
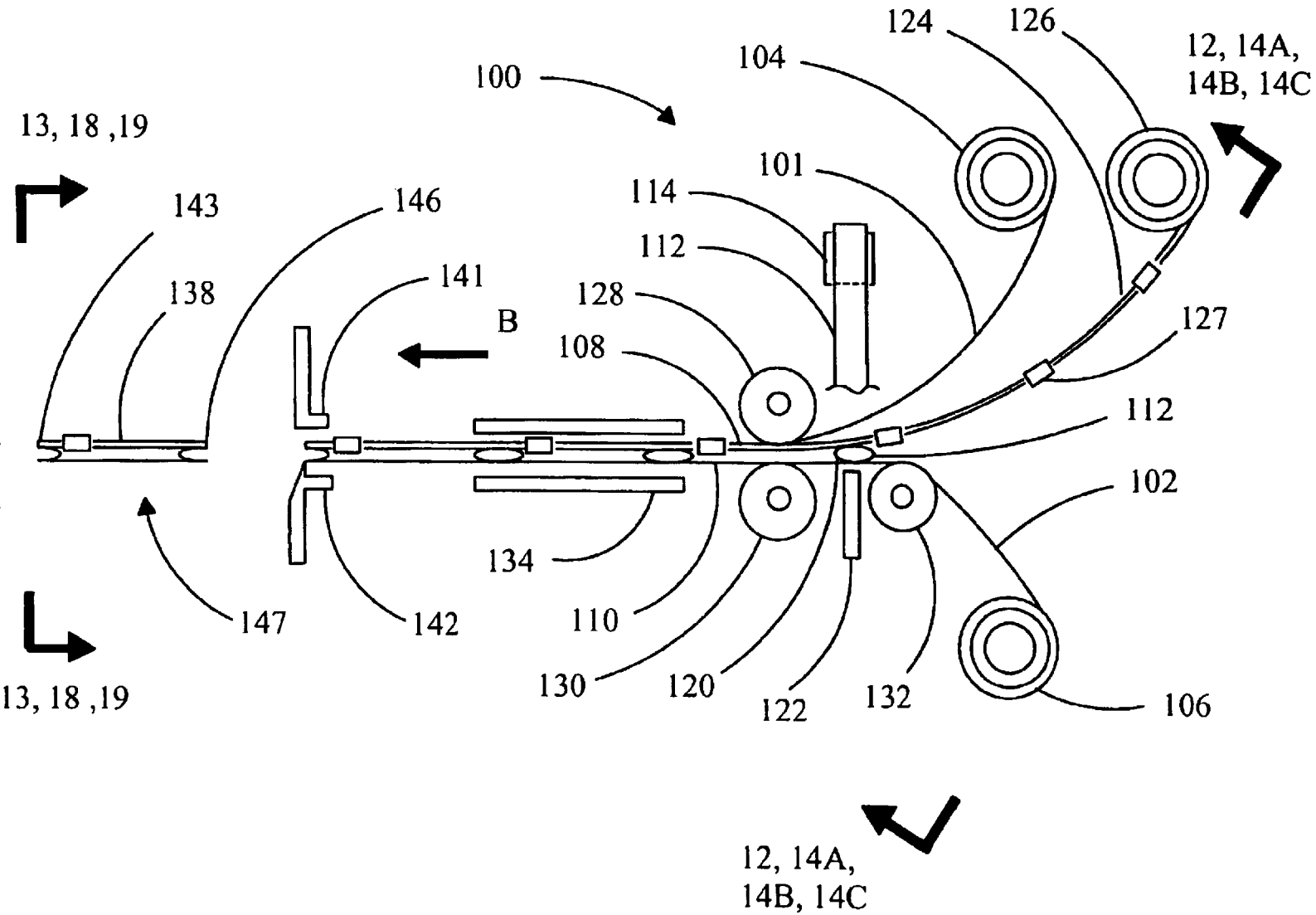
FIG. 11 is a side view of a bag-making apparatus of the second embodiment of the present invention wherein tubular gusset material is applied to the webs of bag-making film and is cut to form a reclosable bag with side gussets.
Figure 12:
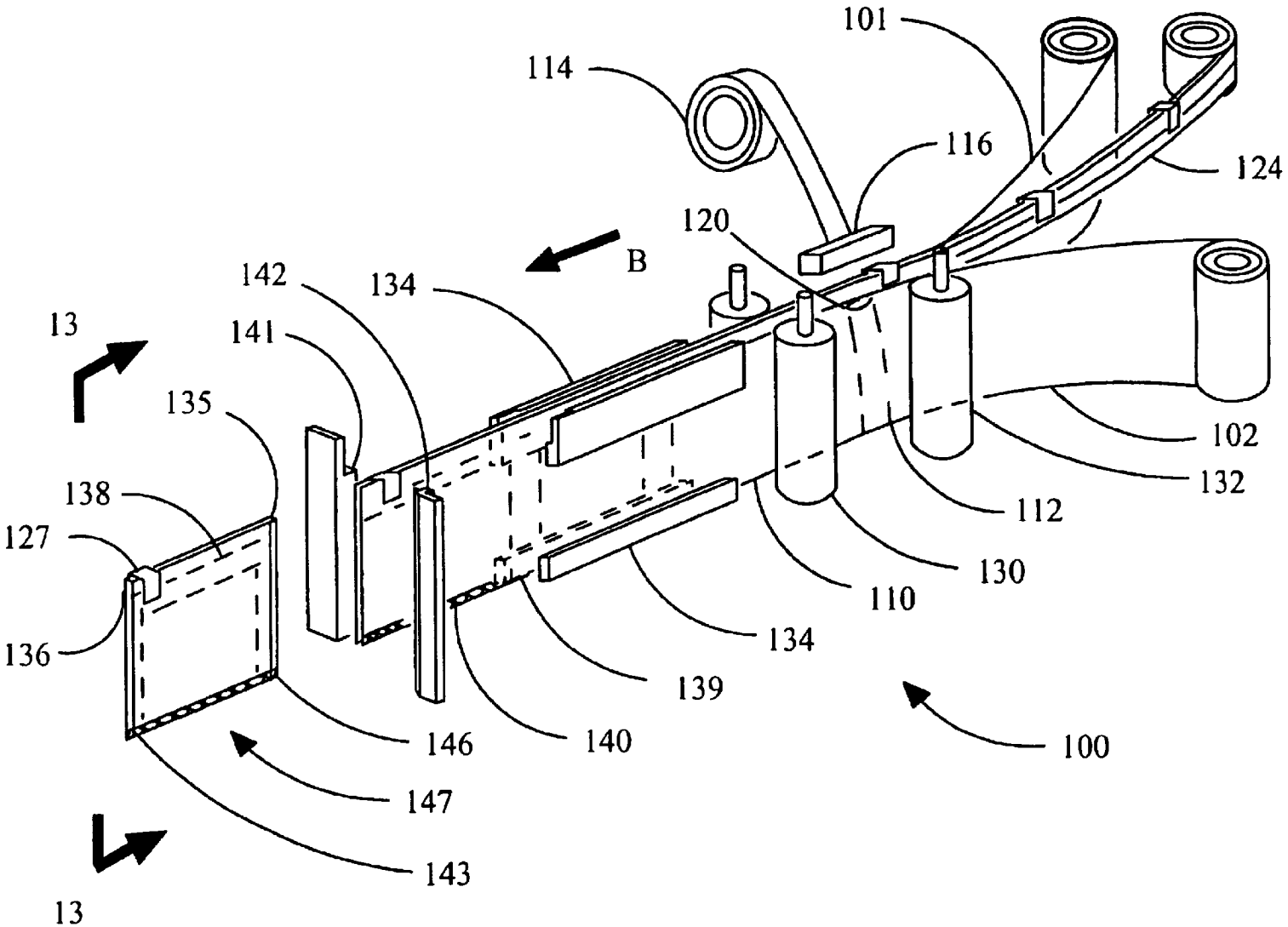
FIG. 12 is an isometric view of the bag-making apparatus of the second embodiment of the present invention with the view taken from the reference line 12—12 of FIG. 11.

In FIG. 11 and in the isometric views of FIGS. 12 and 14 A<, an apparatus 100 of a second embodiment of the present invention and a first variation of the apparatus are depicted. In the figures, a first continuous length of bag-making film 101 and a second continuous length of bag-making film 102 are fed toward each other from their respective supply rolls 104, 106. The first length of bag film 101 is fed to become the upper web 108 and the second length of film 102 is fed to become the lower web 110 of the reclosable bag to be formed.

In FIG. 12, a length of gusset material 112 in the shape of an elongated tube is fed by a supply roll 114 and is separated by a cutter 116 to be positioned on the lower web 110 transverse to the bag-forming direction "B". A first end 120 of the cut gusset material 112 is sealed to the lower web 110 by a sealing section 122. (See FIG. 11 for the sealing section location).

A continuous length of zipper 124 is fed from a supply roll 126 to be positioned on the lower web 110 and on the first end 120 of the gusset material 112 if the zipper includes a slider 127. A set of rollers 128, 130 and 132 advance the webs 108, 110 in direction "B" while flattening the gusset material 112. The zipper 124 is sealed by its flanges to the upper and lower webs 108, 110 and over the first end 120 of the gusset material 112 by a sealing section 134. If desired, the sealing section 134 may also form end stops 135, 136 on the closure area 138 of the zipper 124. The sealing section 134 also seals the upper and lower webs 108, 110 to each other as well as to a second end 139 of the gusset material 112 to form the end seal 140.

The width of the zipper may also be wholly positioned on the gusset material 112 if the zipper does not include a slider. The rollers 128, 130 and 132 advance the upper and lower webs 108, 110 in direction "B" while flattening the gusset material 112 between the upper and lower webs. The zipper 124 is sealed to the webs 108, 110 and on the gusset material 112 by the sealing section 134. The sealing section 134 also seals the upper and lower webs 108, 110 to each other as well as to the second end 139 of the gusset material 112 to form the end seal 140.

The assembly of the webs 108, 110 and the zipper 124 is advanced between cross-sealers 141, 142 where the assembly is cut transversely to direction "B" and sealed to form a seal at the leading edge 143. The cross-sealers 141, 142 also cut the tubular length of gusset material 112 along a centerline of the length to form the side gusset 144 while sealing the cut section of the gusset material to the webs 108, 110 as part of the transverse seal 145. (See FIG. 13 for the location of the transverse seal).

In FIG. 11, the assembly of the webs 108, 110, the zipper 124 and the gusset material 112 is advanced at a reclosable bag width interval. The cross-sealers 141, 142 cut a trailing edge 146 in the webs 108, 110 and in the zipper 124 to form the reclosable bag 147. The cross-sealers 141, 142 also cut the tubular length of a second section of gusset material 112 along a centerline of the length to form the side gusset 148 while sealing the cut section of the gusset material to the webs 108, 110 as part of the transverse seal 149. (See FIG. 13 for the location of the transverse seal).

Figure 14A:
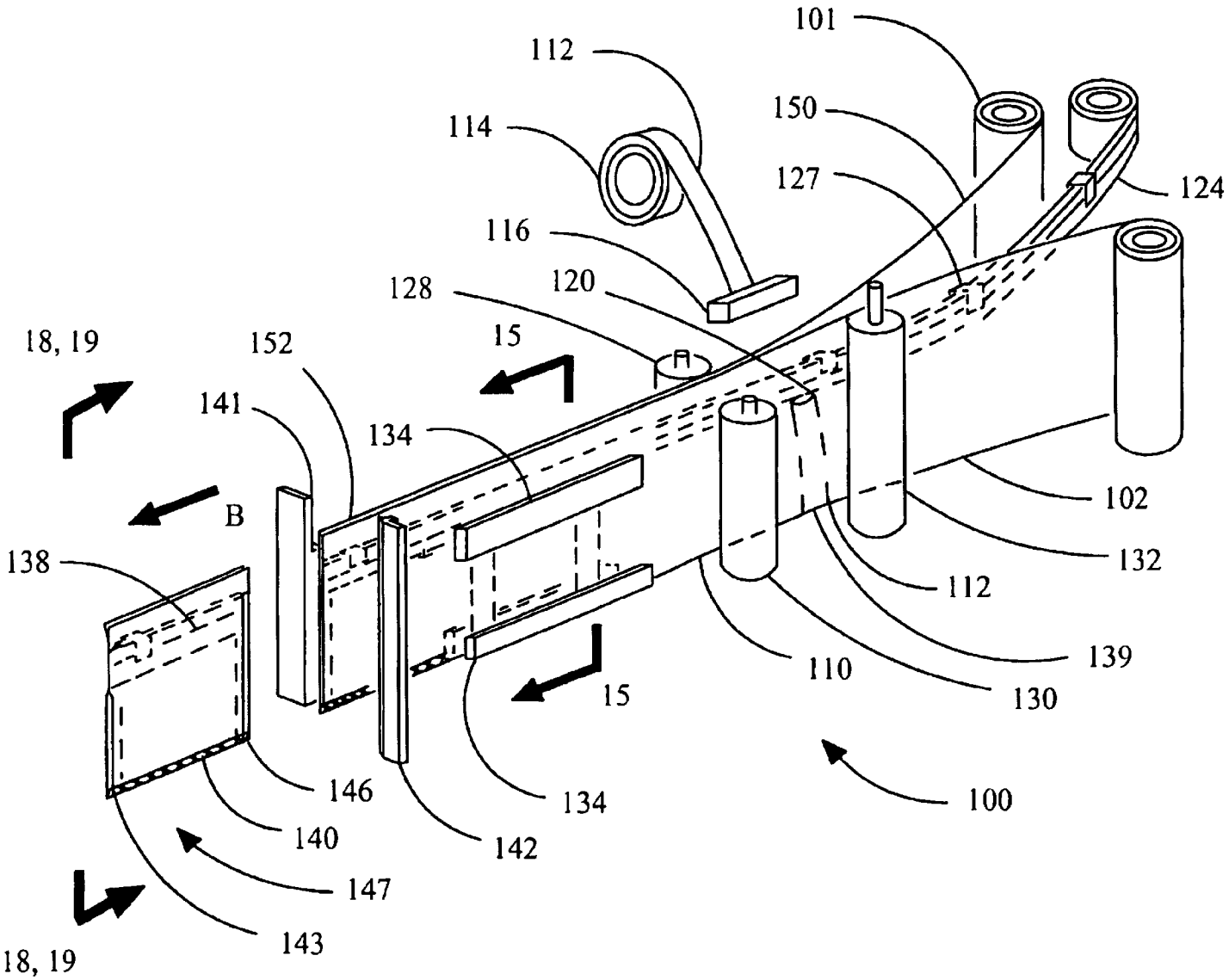
FIG. 14A is a partial isometric view of the bag-making apparatus of a first variation of the second embodiment of the present invention wherein the view includes the addition of film extensions for the reclosable bag and with the view taken from reference line 14A—14A of FIG. 1.
Figure 14B:
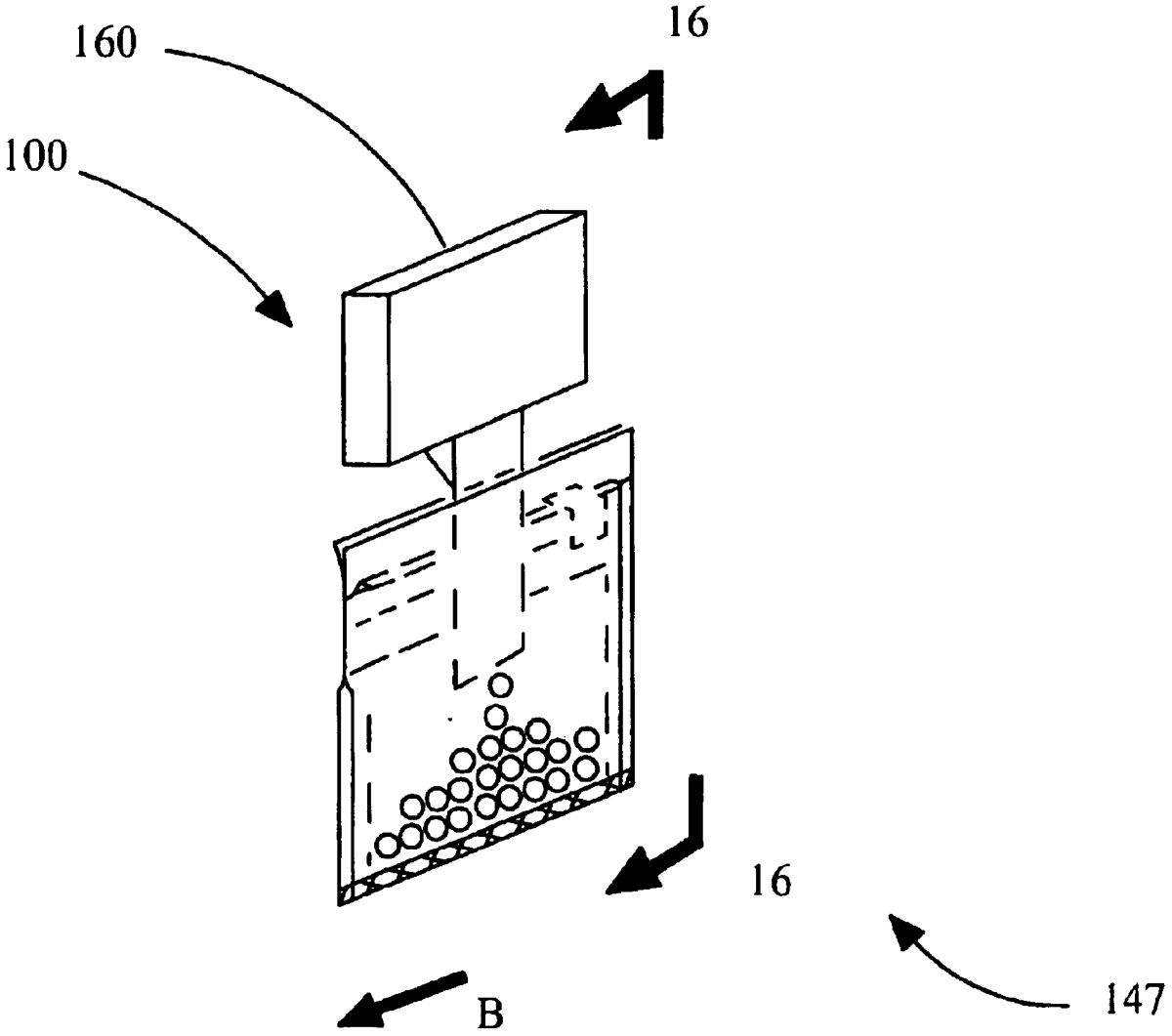
FIG. 14B is a partial isometric view of the bag-making apparatus of the first variation of the second embodiment of the present invention wherein the reclosable bag is filled with a consumer product, with the view continued from FIG. 14A.
Figure 14C:
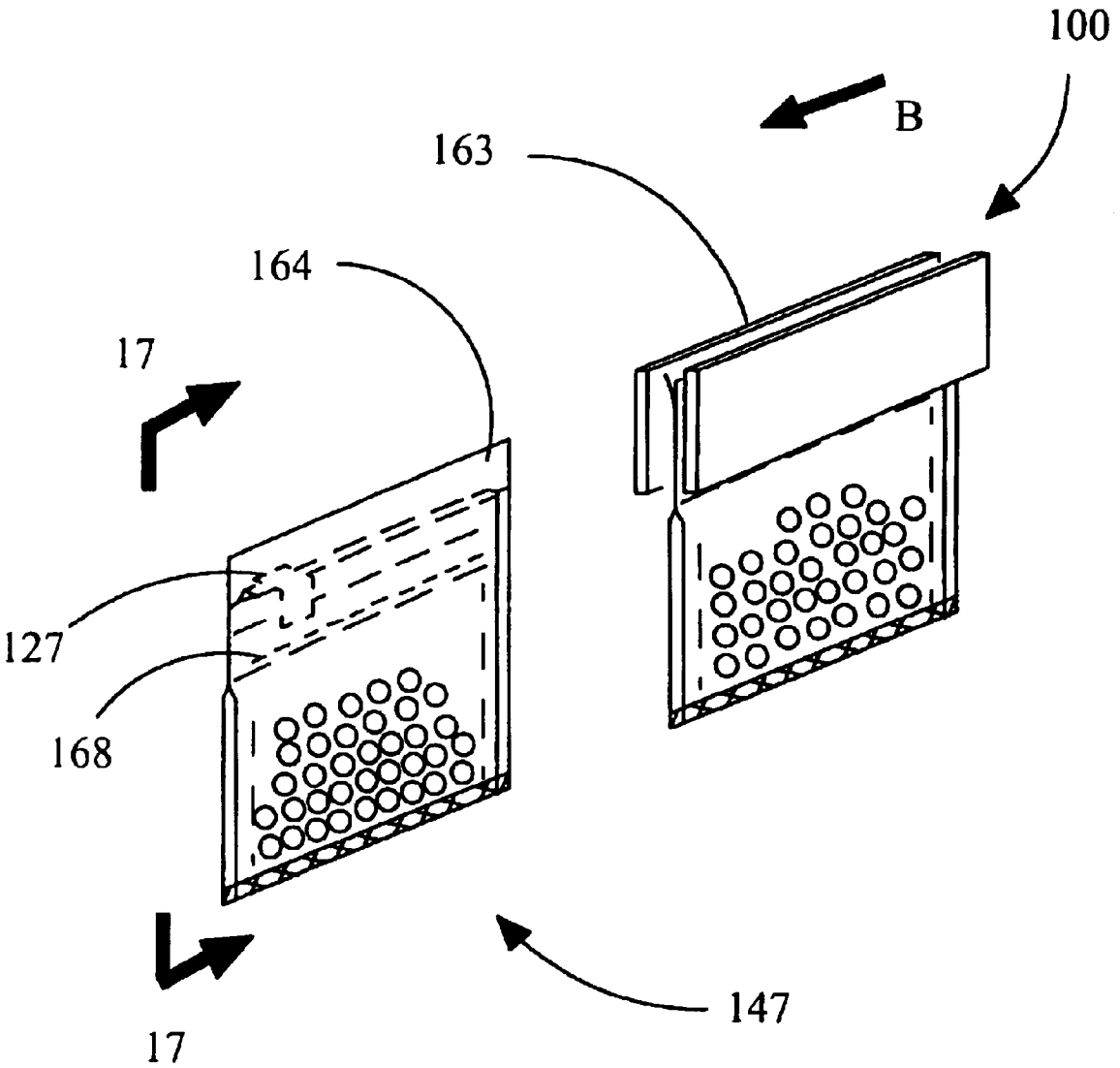
FIG. 14C is a partial isometric view of the bag making apparatus of the first variation of the second embodiment of the present invention wherein the film extensions are sealed as a tamper-evident feature, with the view continued from FIG. 14B.

In a first variation of the second embodiment shown in the continuous views of FIGS. 14A–14C, the length of zipper 124 is fed from a supply roll 126 to be positioned on the lower web 110 and on the first end 120 of the gusset material 112. The zipper 124 is positioned in the direction of and adjacent to a edge 150 of the lower web 110 to provide a film extension 152 between the zipper and the edge of the lower web. The rollers 128, 130 and 132 advance the webs 108, 110 in direction "B" while flattening the gusset material 112. The zipper 124 is sealed by one of its flanges to the lower web 110 and over the first end 20 of the gusset material 112 by the sealing section 134.

Figure 15:
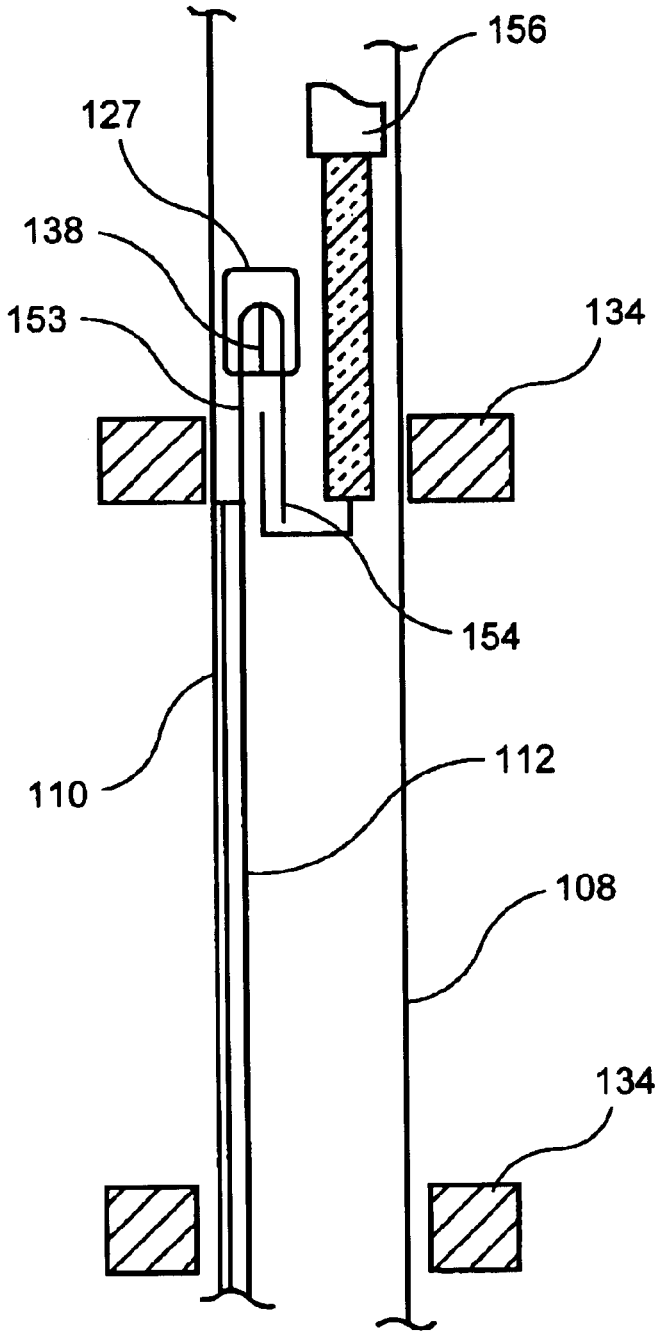
FIG. 15 is an end view of a zipper sealing section of the apparatus of the first variation of the second embodiment wherein the view includes the addition of an insulator with the view taken from reference line 15—15 of FIG. 14 A.

As shown in the end view of FIG. 15, a first interlocking profile 153 of the zipper 124 is sealed to the lower web 110 while the facing and interlocking second profile 154 is prevented from sealing to the upper web 108 by an insulator 156. The second profile 154 is sealed to the upper web 108 after the reclosable bag 147 is filled, as will be discussed below. The scaling section 134 of FIG. 14A also seals the upper and lower webs 108, 110 to each other as well as to the second end 139 of the gusset material 112 to form the end seal 140.

The assembly of the webs 108, 110, the gusset material 112 and the zipper 124 is advanced between the cross-sealers 141, 142 where the assembly is cut transversely to direction "B" and sealed to form a seal at the leading edge 143. The cross-sealers 141, 142 also cut the tubular length of gusset material 112 along a centerline of the length to form the side gusset 144 while sealing the cut section of the gusset material to the webs 105, 110 as part of the transverse seal 145. (See FIG. 18 for the location of the transverse seal)

In FIG. 14A the assembly of the webs 108, 110, the zipper 124 and the gusset material 112 is advanced at a reclosable bag width interval. The cross-sealers 141, 142 cut a trailing edge 146 in the webs 108, 110 and in the zipper 124 to form the reclosable bag 147. The cross-sealers 141, 142 also cut the tubular length of a second section of gusset material 112 along a centerline of the length to form the side gusset 148 while sealing the cut section of the gusset material to the webs 108, 110 as part of the transverse seal 149. (See FIG. 18 for the location of the transverse seal).

Figure 16:
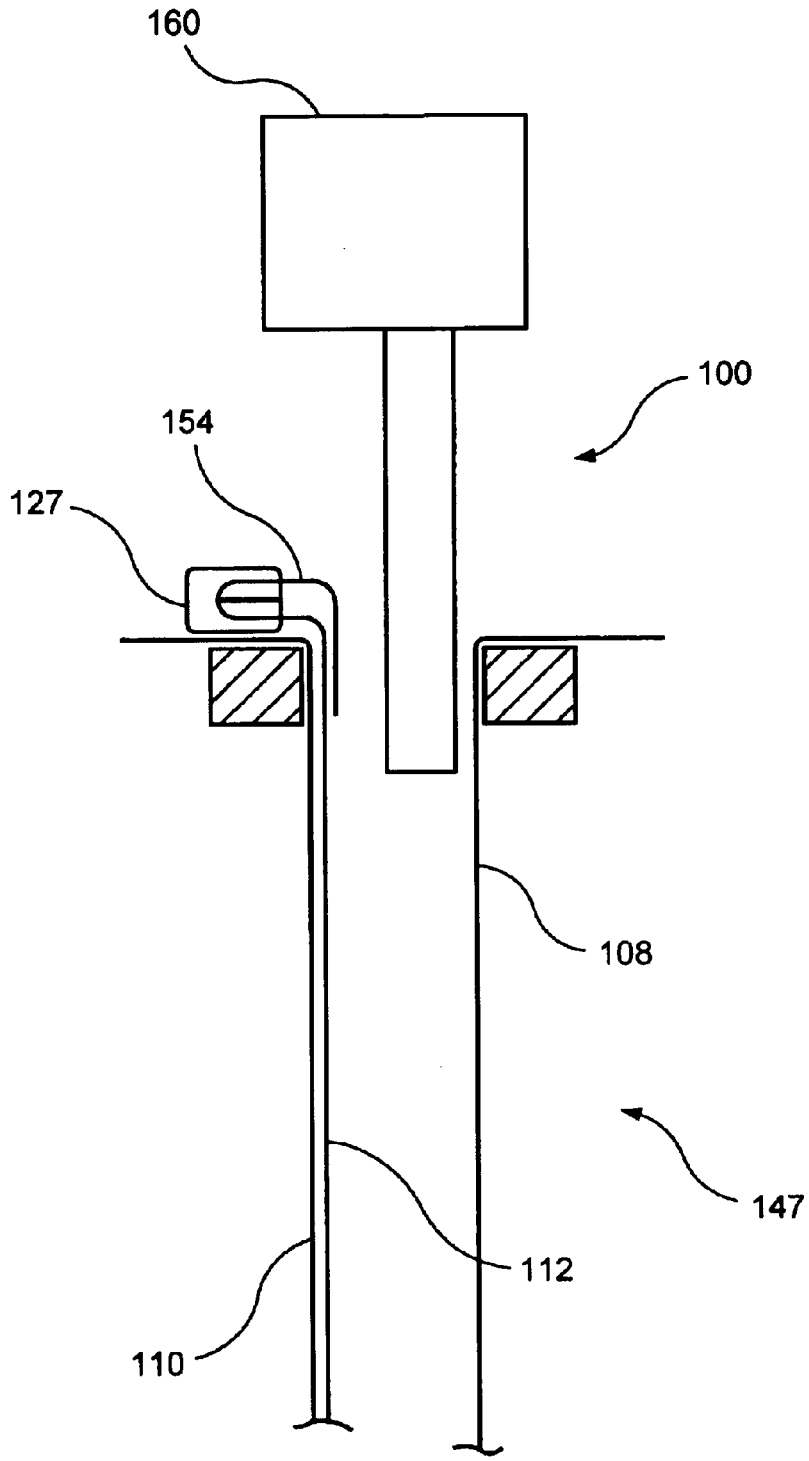
FIG. 16 is an end view of the product filling station of the apparatus of the first variation of the second embodiment with the view taken from reference line 16—16 of FIG. 14B.

In the continuing view of FIG. 14B, the reclosable bag 147 proceeds in direction "B" to a filling station 160 where the bag is filled between the second profile 154 and the upper web 108, as also shown in FIG. 16. After filling and in the continuing view of FIG. 14C, a sealing section 163 seals the second profile 154 to the upper web 108 and also providing a film extension 164 between the zipper 124 and the edge of the upper web. The film extensions 152, 164 are sealed at their edges to form a tamper-evident feature 166. (See FIG. 17 for the depiction of the tamper-evident feature) An internal cutting device of the sealing section 163 perforates the film extensions 152, 164 as a weakness area 168 near or on the film extension 164 and a weakness area (not shown) near or on the film extension 152. The weakness areas allow the film extensions 152, 164 to be tom way adjacent the zipper 124 in order to access the contents of the formed reclosable bag 147.

Figure 13:
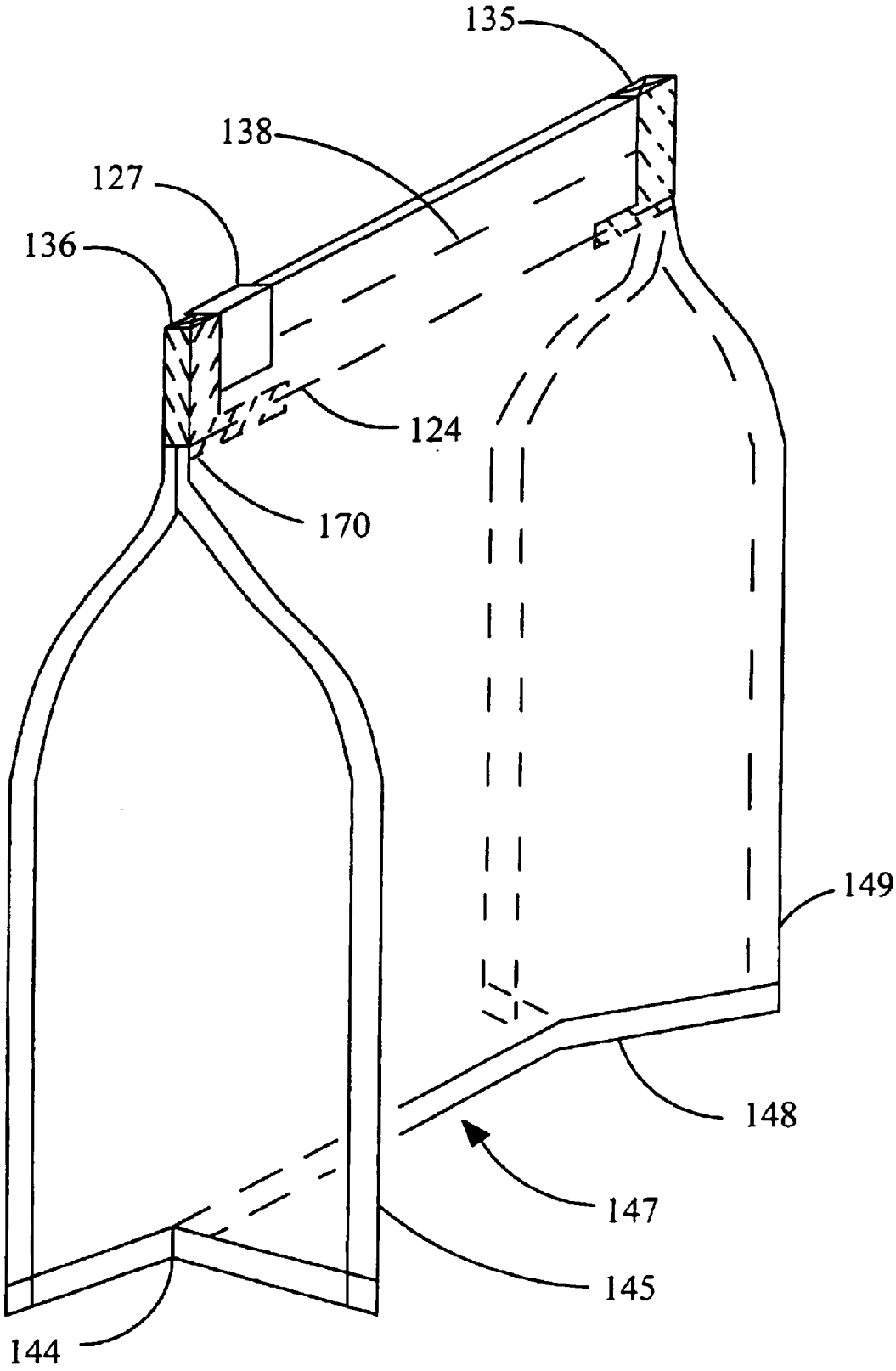
FIG. 13 is a perspective view of a reclosable bag formed by the second embodiment of the present invention wherein the sealed area of the side gussets to the zipper forms a border area adjacent the interlocking elements of the zipper, with the view taken from reference line 13—13 of FIGS. 11 and 12.
Figure 17:
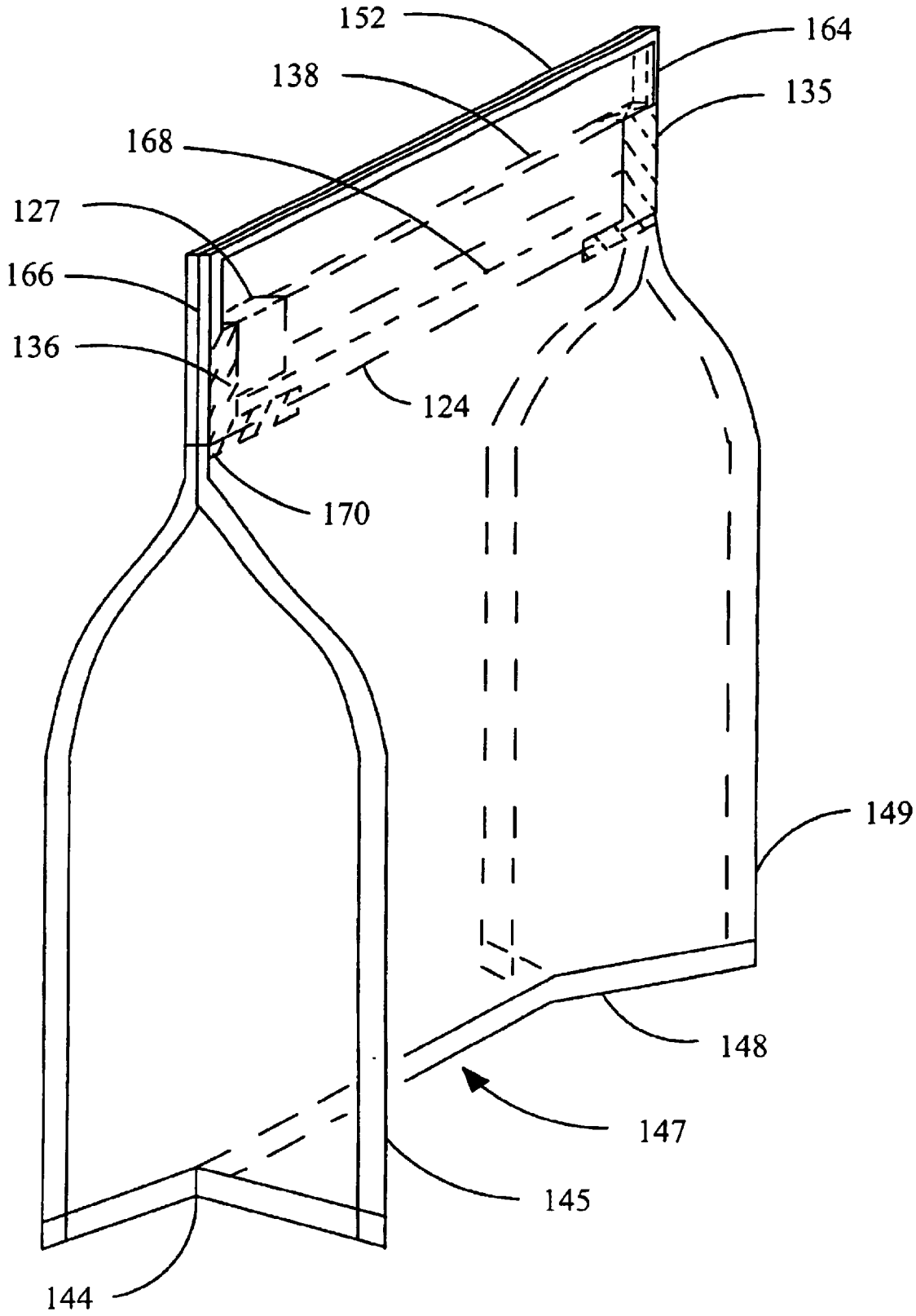
FIG. 17 is a perspective view of a reclosable bag formed by the first variation of the second embodiment wherein a tamper-evident feature is formed adjacent the reclosable zipper, with the view taken from reference line 17—17 of FIG. 14C.
Figure 18:
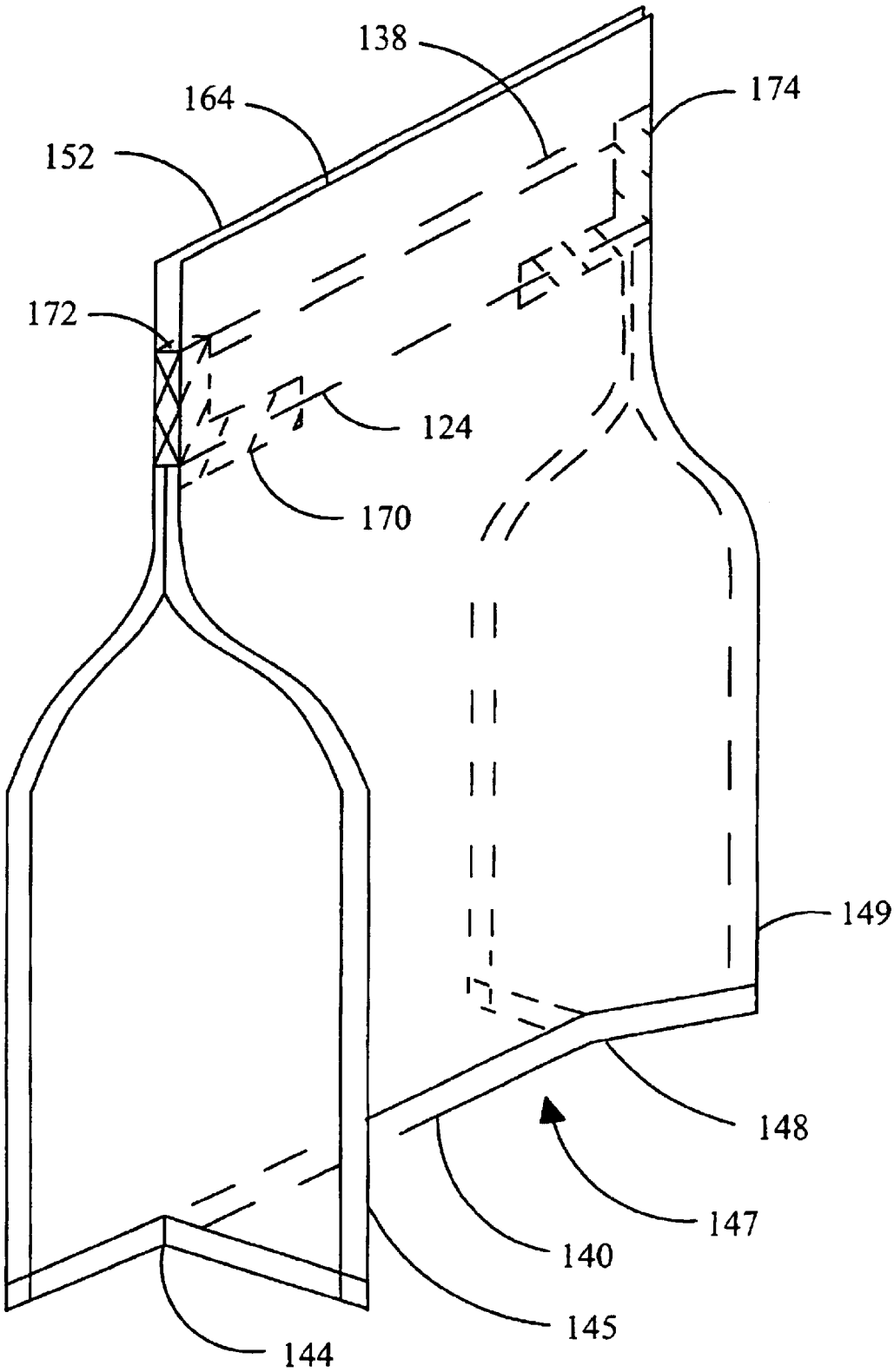
FIG. 18 is a perspective view of a reclosable bag formed by the first variation of the second embodiment of the present invention wherein the reclosable bag includes film extensions as grip flanges adjacent the zipper of the reclosable bag, with the view taken from reference line 18—18 of FIGS. 11 and 14A.
Figure 19:
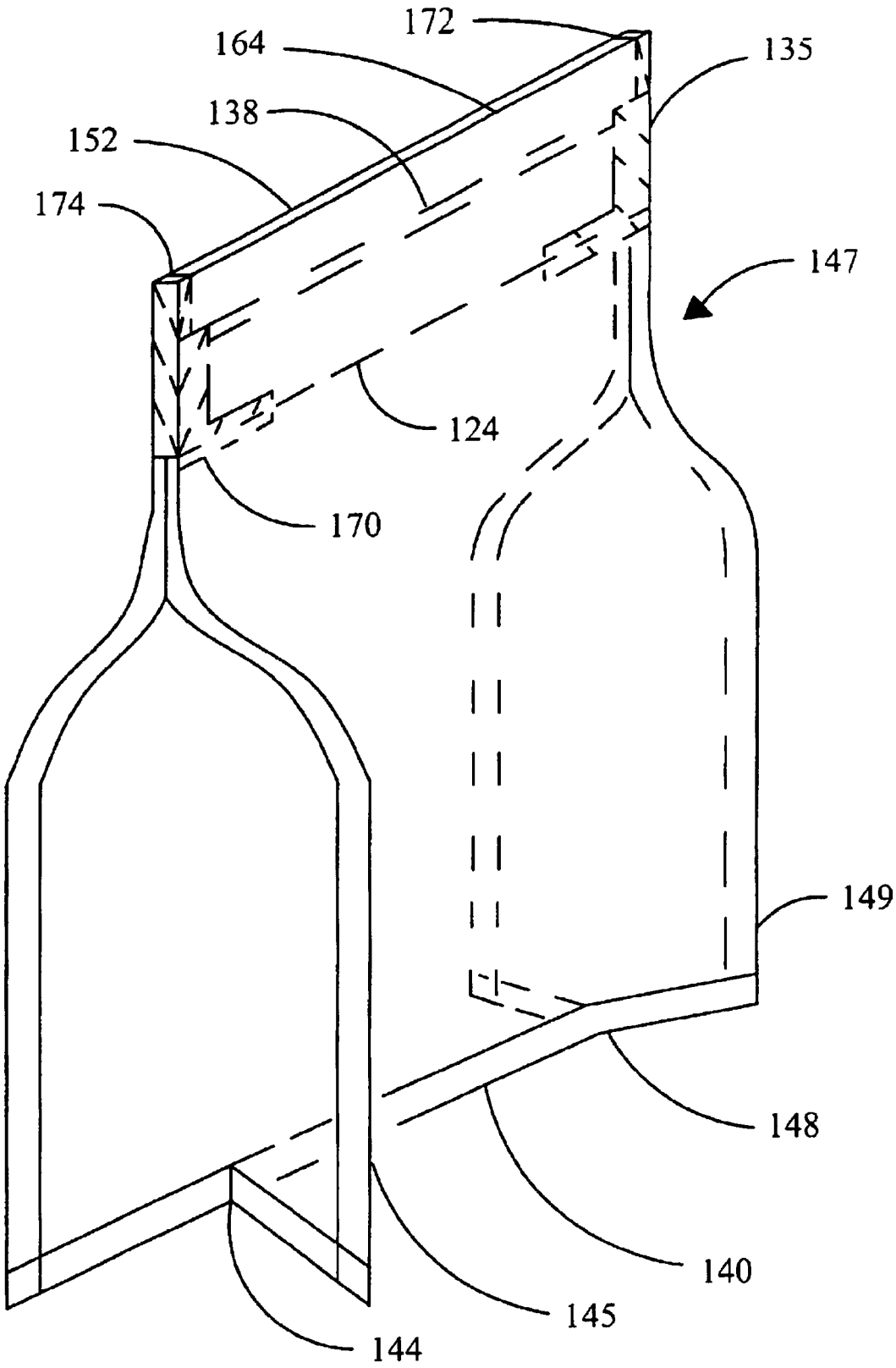
FIG. 19 is a perspective view of a reclosable bag formed by the first variation of the second embodiment of the present invention wherein the reclosable bag includes film extensions as grip flanges with end seals on the film extensions, with the view taken from reference line 19—19 of FIGS. 11 and 14A.

When the side gussets 144, 148 are sealed to the zipper 124 as described in accordance with FIGS. 11 and 14, the sealing forms the border area 170 of FIGS. 13 and 17–19 in which the border area protects the interior of the reclosable bag 147. The reclosable bag 147 may be formed with a zipper 124 that includes the slider 127 as shown in FIGS. 13 and 17; with a zipper with the film extensions 152, 164 as grip flanges, as shown in FIG. 18; or with a zipper with the film extensions sealed at breakable end seals 172, 174, as shown in FIG. 19; or any variation of the figures shown.

Figure 20:
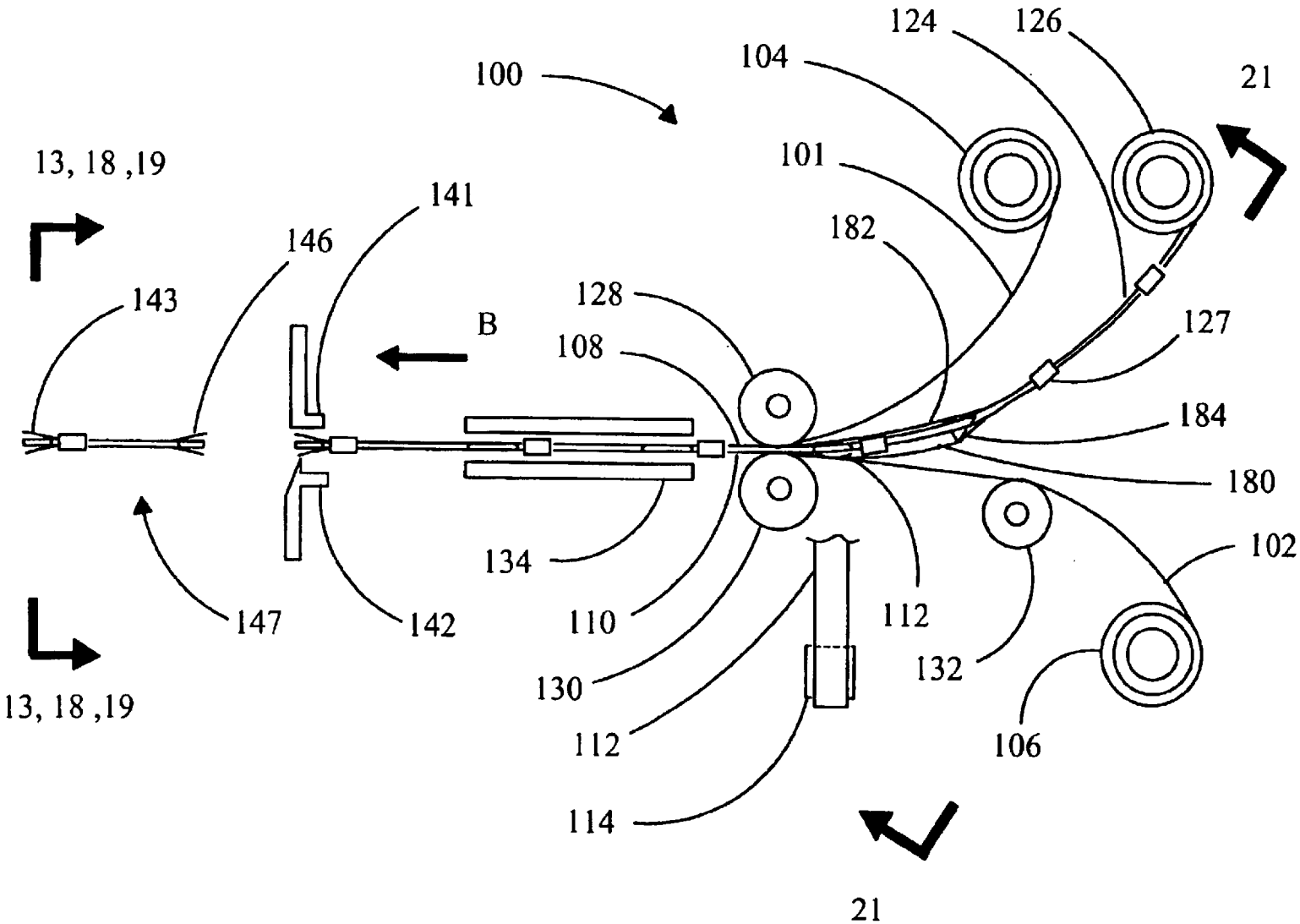
FIG. 20 is a side view of a bag-making apparatus of a second variation of the second embodiment of the present invention wherein tubular gusset material is positioned between the flanges of the zipper and to the bag-making film and is cut to form a reclosable bag with side gussets.
Figure 21:
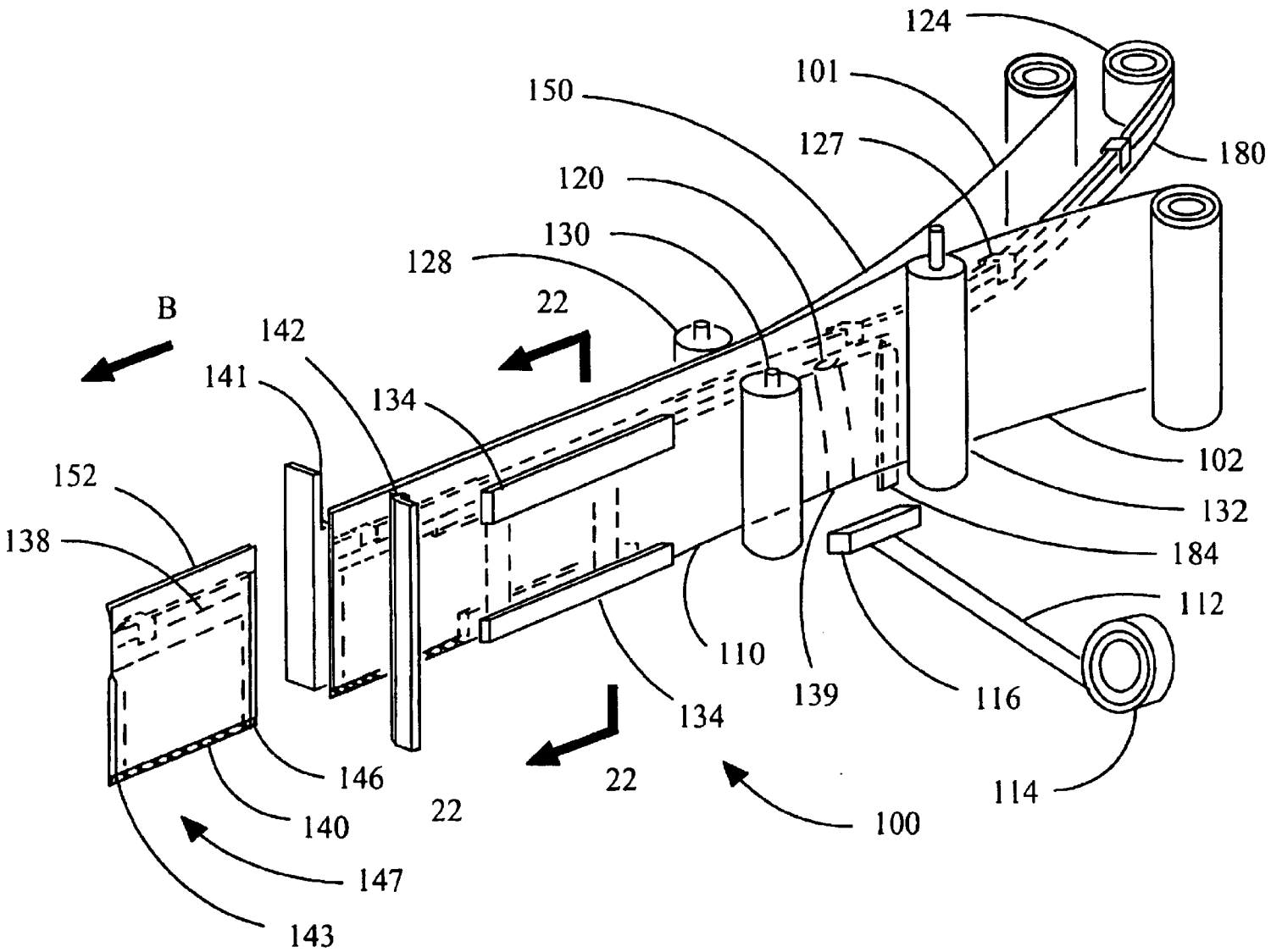
FIG. 21 is an isometric view of the bag-making apparatus of the second variation of the second embodiment of the present invention wherein the view includes the addition of film extensions for the reclosable bag and with the view taken from the reference line 21—21 of FIG. 20.

In a second variation of the second embodiment shown in FIGS. 20 and 21, the length of zipper 124 is fed from a supply roll 126 to be positioned with one flange 180 of the zipper on the lower web 110 and another flange 182 of the zipper on the first end 120 of the gusset material 112. The flanges 180, 182 of the zipper 124 are separated by a knife-edge wedge 184 prior to positioning on the lower web 110 and the gusset material 112. The length of zipper 124 may be positioned in the direction of and adjacent to a edge 150 of the lower web 110 to provide a film extension 152 between the zipper and the edge of the lower web. The rollers 128, 130 and 132 advance the webs 108, 110 in direction "B" while flattening the gusset material 112. The zipper 124 is sealed by one of its flanges to the lower web 110 and over the first end 120 of the gusset material 112 by the scaling section 134.

Figure 22:
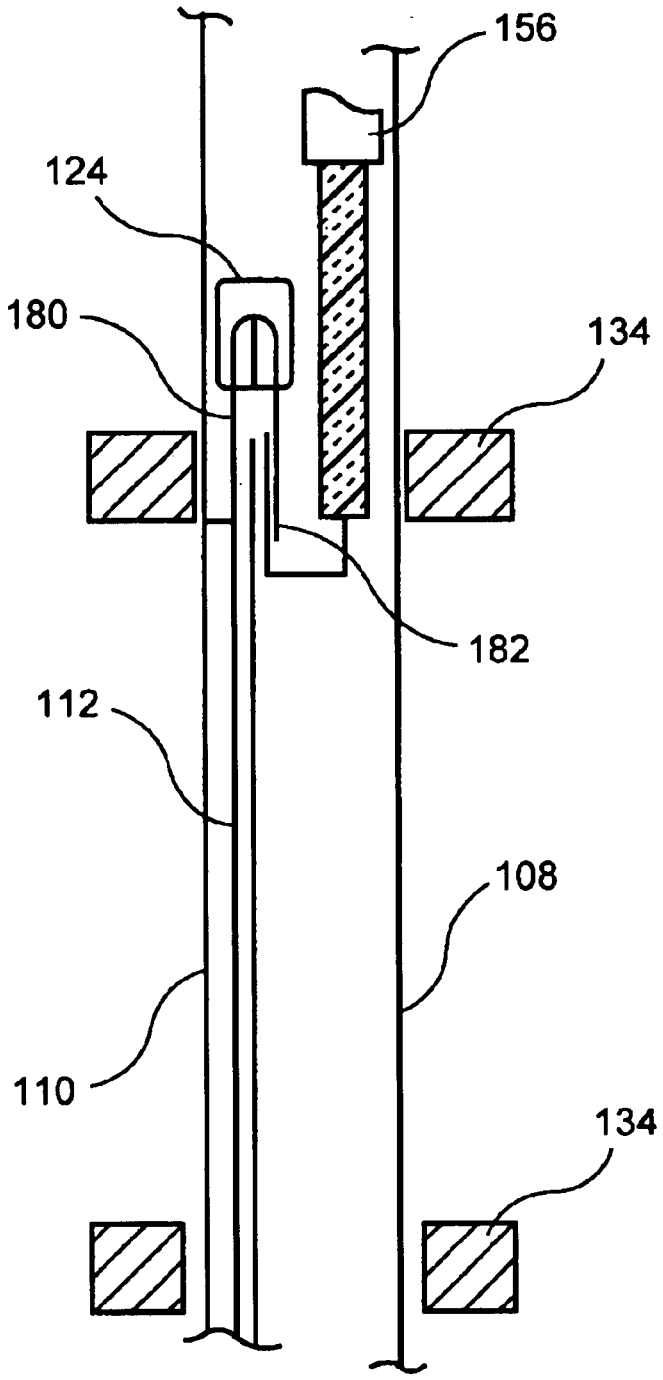
FIG. 22 is an end view of a zipper sealing section of the apparatus of the second variation of the second embodiment of the present invention wherein the view includes the addition of an insulator with the view taken from reference line 22—22 of FIG. 21.

As shown in FIG. 22, the flange 180 of the zipper 124 is sealed to the lower web 110 and the flange is sealed to the gusset material 112. The flange 182 is prevented from sealing to the gusset material 112 and the upper web 108 by the insulator 156. The flange 182 is later sealed to the gusset material 112 and to the upper web 108 of the reclosable bag 147 using the sealing section 163 depicted in FIG. 14C. The sealing section 134 of FIG. 22 also seals the upper and lower webs 108, 110 to each other as well as to the second end 139 of the gusset material 112 to form the end seal 140.

The assembly of the webs 108, 110 and the zipper 124 is advanced between the cross-sealers 141, 142 where the assembly is cut transversely to direction "B" and sealed to form a seal at the leading edge 143. The cross-sealers 141, 142 also cut the tubular length of gusset material 112 along a centerline of the length to form the side gusset 144 while sealing the cut section of the gusset material to the webs 108, 110 as part of the transverse seal 145. (See FIG. 13 for the location of the transverse seal).

As shown in FIG. 20, the assembly of the webs 108, 110, the zipper 124 and the gusset material 112 is advanced at a reclosable bag width interval. The cross-sealers 141, 142 cut a trailing edge 146 in the webs 108, 110 and in the zipper 124 to form the reclosable bag 147. The cross-sealers 141, 142 also cut the tubular length of a second section of gusset material 112 along a centerline of the length to form the side gusset 148 while sealing the cut section of the gusset material to the webs 108, 110 as part of the transverse seal 149. (See FIG. 13 for the location of the transverse seal).

For filling the reclosable bag 147 and creating the tamper-evident feature 166, the reclosable bag proceeds to the sections of the apparatus shown in FIGS. 14B and 14C. When the side gussets 144, 148 are sealed to the zipper 124 as shown in FIGS. 14C, 20 and 21, the scaling forms the border area 170 of FIGS. 13 and 17–19 in which the border area protects the interior of the reclosable bag 147.

Figure 23:
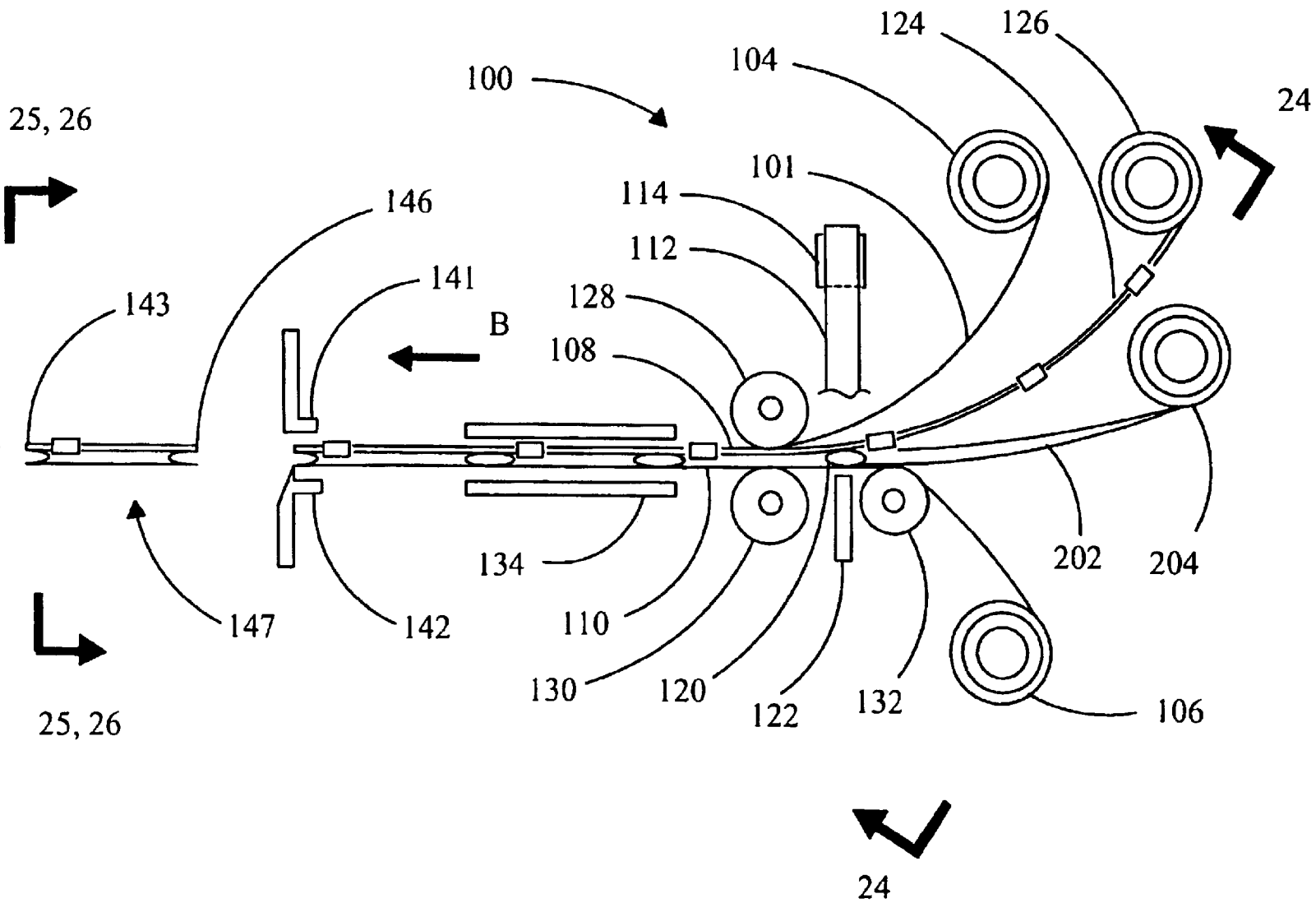
FIG. 23 is a side view of a bag-making apparatus of a third variation of the second embodiment of the present invention wherein a reclosable bag is formed with side gussets and with a bottom gusset.
Figure 24:
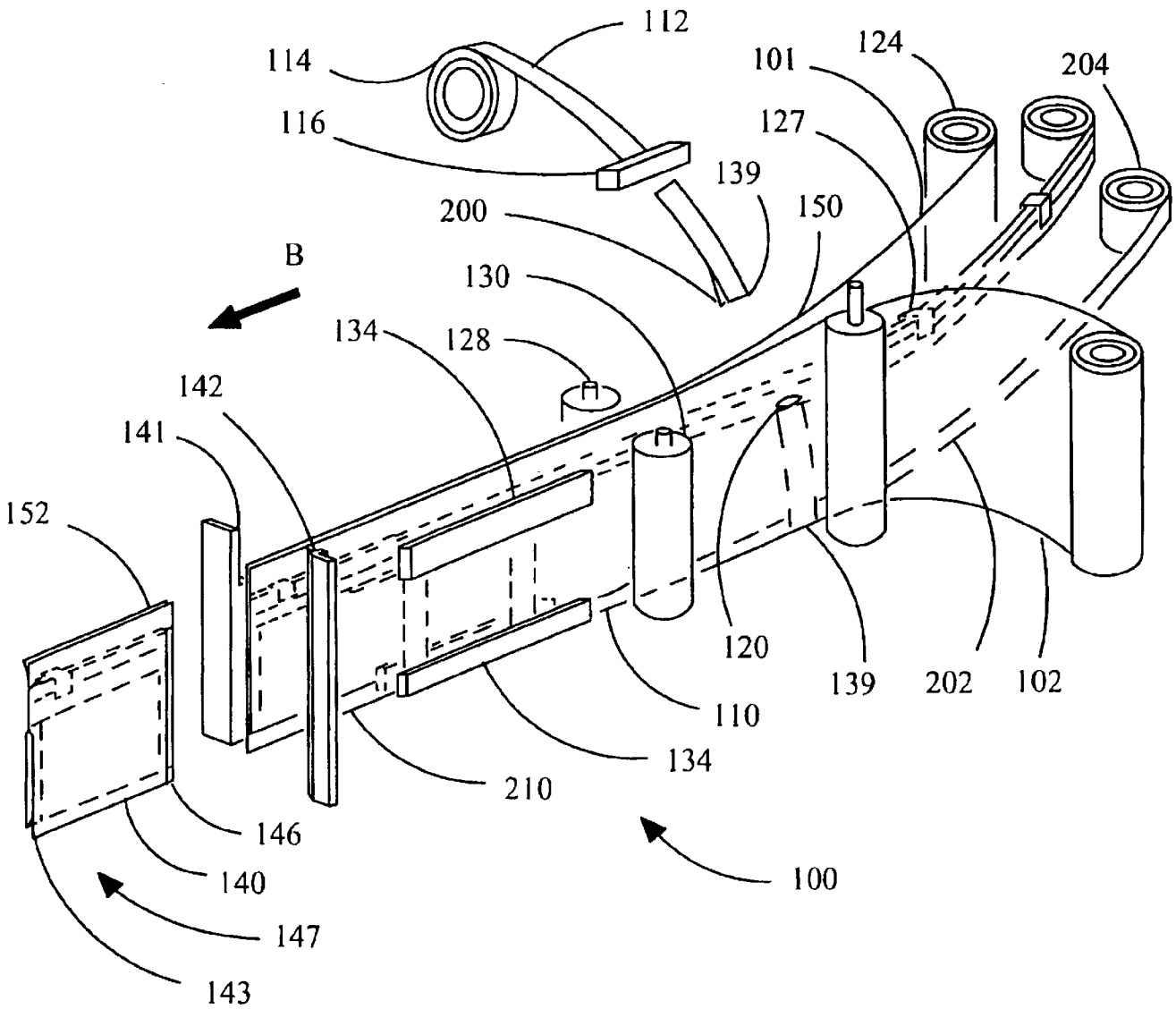
FIG. 24 is an isometric view of the bag-making apparatus of the third variation of the second embodiment present invention wherein the view includes the addition of film extensions for the reclosable bag and with the view taken from the reference line 24—24 of FIG. 23.

In a third variation of the second embodiment shown in FIGS. 23 and 24, the length of gusset material 112 in the shape of an elongated tube is fed and is separated from the supply roll 114 by the cutter 116. When the gusset material 112 is separated, an internal cutting device of the cutter 116 creates a slit 200 in the end 139 of the gusset material. The slit 200 is sized to accommodate the semi-elliptical shape of a second length of gusset material 202 fed in bag-forming direction "B" from a supply roll 204. The gusset material 112 is positioned on the lower web 110 transverse to the bag-forming direction "B" with the slit 200 of the gusset material encompassing the gusset material 202. The end 120 of the cut gusset material 112 is tack-sealed to the lower web 110 by the sealing section 122.

The length of zipper 124 is fed from a supply roll 126 to be positioned on the lower web 110 and on the end 120 of the gusset material 112. The length of zipper 124 is positioned in the direction of and adjacent to an edge 150 of the lower web 110 to provide the film extension 152 between the zipper and the edge of the lower web. The rollers 128, 130 and 132 advance the webs 108, 110 in direction "B" while flattening the gusset material 112 and the gusset material 202.

The zipper 124 is sealed by one of its flanges to the lower web 110 and over the end 120 of the gusset material 112 by the sealing section 134. As shown in FIG. 15, a first interlocking profile 153 of the zipper 124 is sealed to the lower web 110 while the facing and interlocking second profile 154 is prevented from sealing to the upper web 108 by the insulator 156. The second profile 154 is sealed to the upper web 108 after the reclosable bag 147 is filled, as discussed for FIGS. 14B and 14C.

Figure 25:
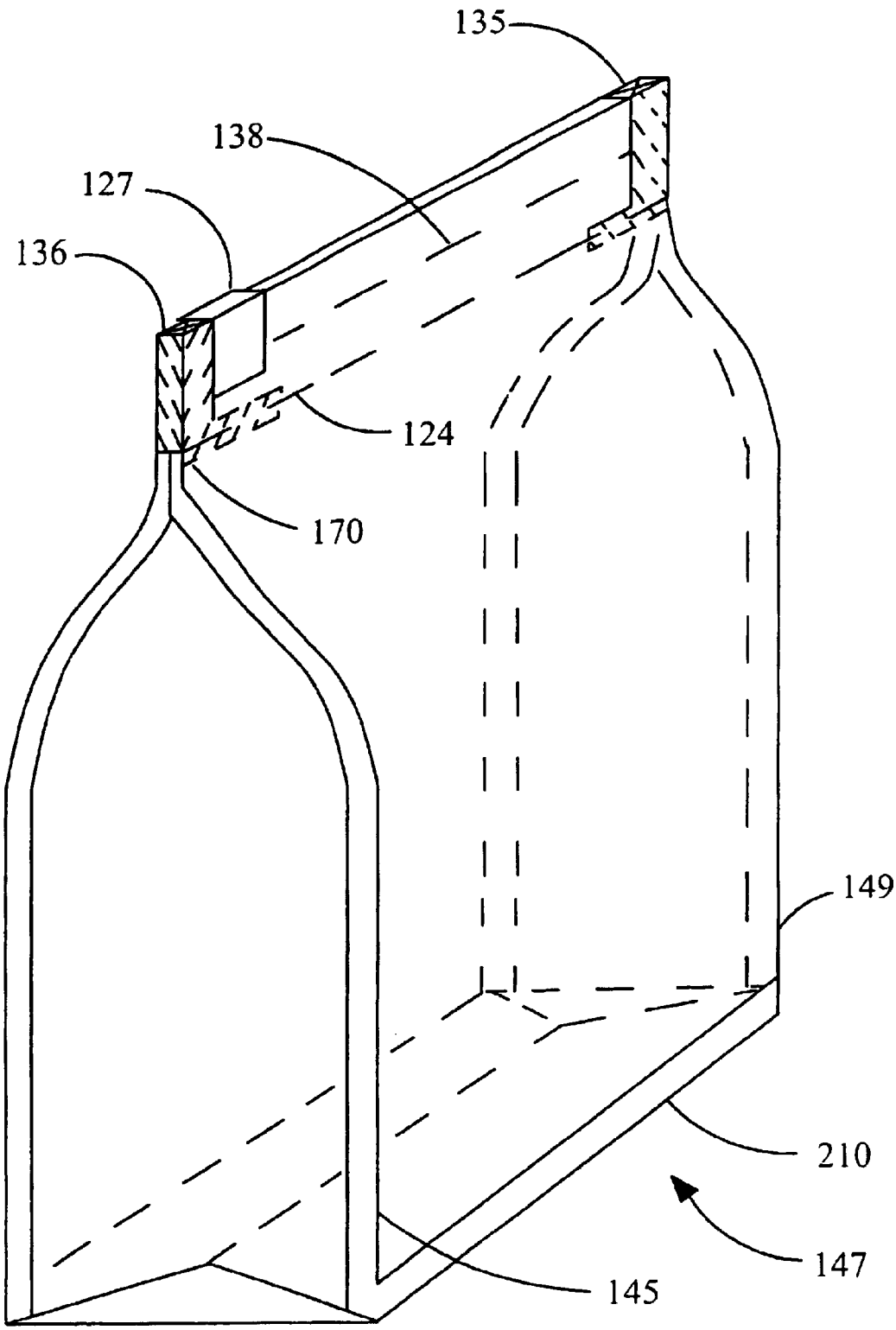
FIG. 25 is a perspective view of a reclosable bag formed by the third variation of the second embodiment wherein the reclosable bag includes a bottom gusset in addition to the side gussets, with the view taken from reference line 25—25 of FIG. 23.
Figure 26:
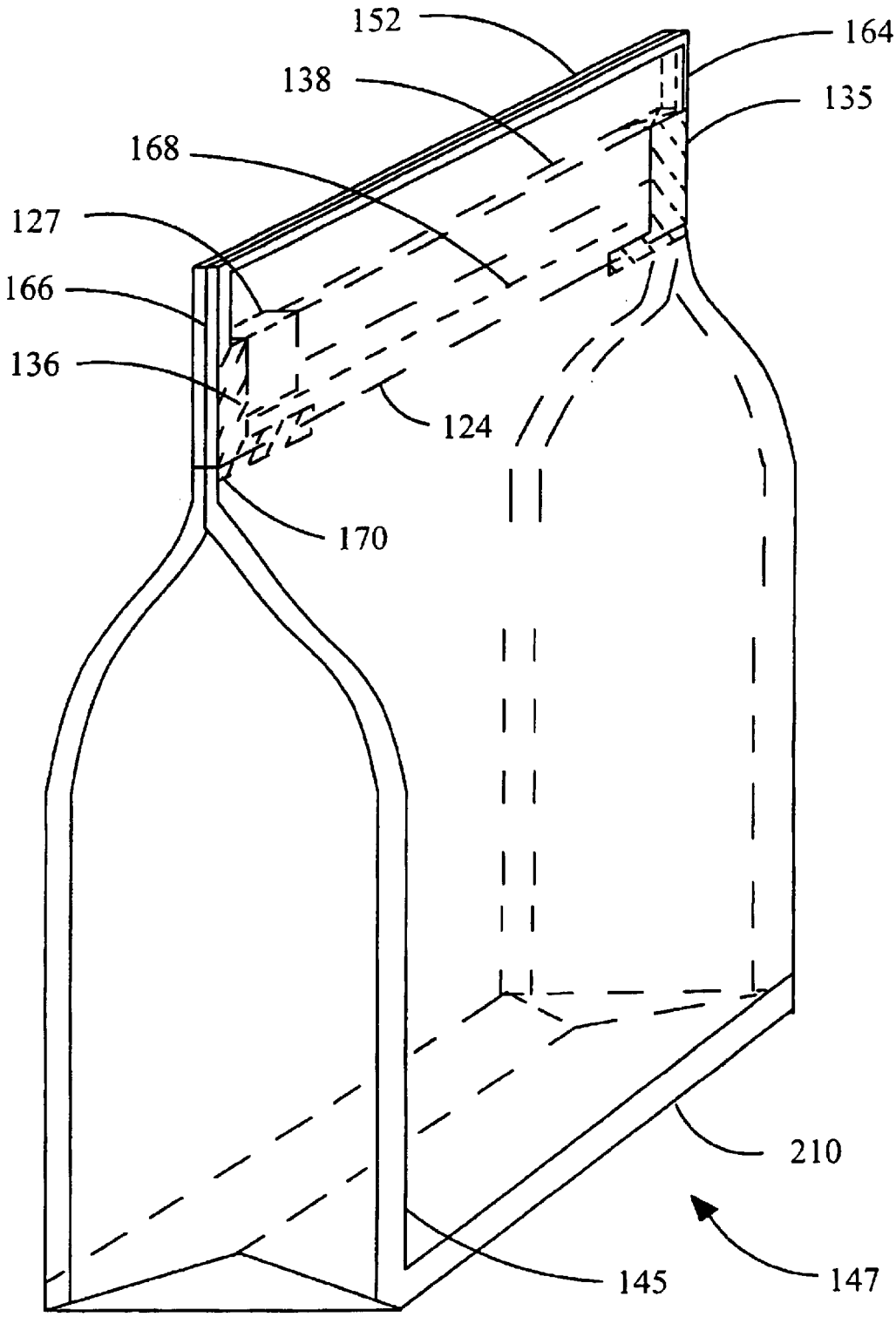
FIG. 26 is a perspective view of a reclosable bag formed by the third variation of the second embodiment wherein the reclosable bag includes a bottom gusset and film extensions, with the view taken from reference line 25—25 of FIG. 23.

As shown in FIG. 23, the sealing section 134 also seals the upper and lower webs 108, 110 and the end 139 of the gusset material 112 to the gusset material 202, in which the gusset material 202 now forms a bottom gusset 210. (See FIGS. 25 and 26 for the location of the bottom gusset) The sealing section 134 of FIG. 23 further seals the upper and lower webs 108, 110 to the end 139 of the gusset material 112 as part of the end seal 140.

The assembly of the webs 108, 110, the bottom gusset 210 and the zipper 124 are advanced between the cross-sealers 141, 142 where the assembly is cut transversely to direction "B" and sealed to form a seal at the leading edge 143. The cross-sealers 141, 142 also cut the tubular length of gusset material 112 along a centerline of the length to form the side gusset 144 while sealing the cut section of the gusset material to the webs 108, 110 and the bottom gusset 210 as part of the transverse seal 145. (See FIG. 25 for the location of the transverse seal).

As shown in FIG. 23, the assembly of the webs 108, 110, the zipper 124, the gusset material 112 and the bottom gusset 210 are advanced at a reclosable bag width interval. The cross-sealers 141, 142 cut a trailing edge 146 in the webs 108, 110, in the bottom gusset 210 and in the zipper 124 to form the reclosable bag 147. The cross-sealers 141, 142 also cut the tubular length of a second section of gusset material 112 along a centerline of the length to form the side gusset 148 while sealing the cut section of the gusset material to the webs 108, 110 and the bottom gusset 210 as part of the transverse seal 149. (See FIG. 25 for the location of the transverse seal).

For filling the reclosable bag 147 and creating the tamper-evident feature 166, the reclosable bag proceeds to the components of the apparatus shown in FIGS. 14B and 14C. When the side gussets 144, 148 are sealed to the zipper 124 as shown in FIGS. 23 and 24, the sealing forms the border area 170 of FIGS. 25 and 26 in which the border area protects the interior of the reclosable bag 147.

Thus, the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A method for producing a reclosable gusseted bag comprising the steps of:

advancing a length of bag-making film in a bag-forming direction;

supplying a length of zipper having first and second interlockable profiles joined by their interlocking elements;

attaching the first profile of said length of zipper to a mid-portion of said bag-making film transverse to said bag-forming direction, leaving sides of said bag-making film as side margins from opposite ends of said zipper;

sealing the side margin from one end of said zipper together with the side margin of the other end of said zipper in a fin seal to form a tube;

indenting said sealed side margins of the tube toward said zipper ends to form at least one side gusset in each said side margin, a base of said at least one side gusset bordering a rear wall of said tube;

sealing the second profile of said zipper to a face of said at least one side gusset and to a surface of said rear wall facing the interior of said tube;

sealing an opposite face of said at least one side gusset in alignment with said zipper to said surface of the rear wall;

sealing across said tube at spaced intervals to form a first end seal; and cutting across said tube at spaced intervals on opposite sides of said zipper to form a reclosable bag.

2. The method in accordance with claim 1 wherein said at least one side gusset is sealed adjacent the interlocking elements of said first and second profiles.

3. The method in accordance with claim 2, said method including the additional step of filling the reclosable bag with a consumer product.

4. The method in accordance with claim 3, said method including the additional steps of:

sealing across said tube to form a second end seal on the opposite side of said zipper from said at least one side gusset; and creating a weakness area in said tube between said second end seal and said at least one side gusset.

* * * * *